US007693707B2

(12) United States Patent
Yamanashi et al.

(10) Patent No.: US 7,693,707 B2
(45) Date of Patent: Apr. 6, 2010

(54) VOICE/MUSICAL SOUND ENCODING DEVICE AND VOICE/MUSICAL SOUND ENCODING METHOD

(75) Inventors: Tomofumi Yamanashi, Osaka (JP); Kaoru Sato, Osaka (JP); Toshiyuki Morii, Osaka (JP)

(73) Assignee: Pansonic Corporation, Osaka (JP)

( * ) Notice: Subject to any disclaimer, the term of this patent is extended or adjusted under 35 U.S.C. 154(b) by 372 days.

(21) Appl. No.: 10/596,773

(22) PCT Filed: Dec. 20, 2004

(86) PCT No.: PCT/JP2004/019014

§ 371 (c)(1),
(2), (4) Date: Jun. 23, 2006

(87) PCT Pub. No.: WO2005/064594

PCT Pub. Date: Jul. 14, 2005

(65) Prior Publication Data

US 2007/0179780 A1 Aug. 2, 2007

(30) Foreign Application Priority Data

Dec. 26, 2003 (JP) ..... 2003-433160

(51) Int. Cl.
*G10L 19/00* (2006.01)

(52) U.S. Cl. ..... 704/200.1; 704/200; 704/203; 704/230; 704/222; 704/204; 704/233; 704/229; 704/201; 704/504; 704/223; 704/226; 381/58

(58) Field of Classification Search ..... 704/200.1, 704/233, 229, 201, 504, 200, 203, 230, 222, 704/204, 223, 226; 381/58
See application file for complete search history.

(56) References Cited

U.S. PATENT DOCUMENTS 5,323,486 A * 6/1994 Taniguchi et al. ..... 704/222

(Continued)

FOREIGN PATENT DOCUMENTS

EP 0942411 9/1999

(Continued)

OTHER PUBLICATIONS

Johnston, "Estimation of Perceptual Entropy Using Noise Masking Criteria," Proceedings ICASSP-88, May 1988, pp. 2524-2527.

(Continued)

*Primary Examiner*—Richemond Dorvil
*Assistant Examiner*—Michael C Colucci
(74) *Attorney, Agent, or Firm*—Greenblum & Bernstein P.L.C.

(57) ABSTRACT

A voice and musical tone coding apparatus is provided that can perform high-quality coding by executing vector quantization taking the characteristics of human hearing into consideration. In this voice and musical tone coding apparatus, a quadrature transformation processing section (201) converts a voice and musical tone signal from time components to frequency components. An auditory masking characteristic value calculation section (203) finds an auditory masking characteristic value from a voice and musical tone signal. A vector quantization section (202) performs vector quantization changing a calculation method of a distance between a code vector found from a preset codebook and a frequency component based on an auditory masking characteristic value.

4 Claims, 17 Drawing Sheets

U.S. PATENT DOCUMENTS

| | | | | |
|---|---|---|---|---|
| 5,502,789 | A * | 3/1996 | Akagiri | 704/204 |
| 5,563,953 | A * | 10/1996 | Kwon | 381/58 |
| 5,649,052 | A * | 7/1997 | Kim | 704/226 |
| 5,666,465 | A | 9/1997 | Ozawa | |
| 5,819,212 | A * | 10/1998 | Matsumoto et al. | 704/219 |
| 5,864,797 | A * | 1/1999 | Fujimoto | 704/223 |
| 6,308,150 | B1 * | 10/2001 | Neo et al. | 704/200.1 |
| 6,311,153 | B1 | 10/2001 | Nakatoh et al. | |
| 6,871,106 | B1 | 3/2005 | Ishikawa et al. | |
| 6,988,065 | B1 | 1/2006 | Yasunaga et al. | |
| 6,990,443 | B1 * | 1/2006 | Abe et al. | 704/222 |
| 2001/0044727 | A1 | 11/2001 | Nakatoh et al. | |
| 2002/0013703 | A1 * | 1/2002 | Matsumoto et al. | 704/234 |
| 2003/0115050 | A1 * | 6/2003 | Chen et al. | 704/230 |
| 2005/0163323 | A1 | 7/2005 | Oshikiri | |
| 2006/0080091 | A1 | 4/2006 | Yasunaga et al. | |
| 2006/0173677 | A1 | 8/2006 | Sato et al. | |
| 2007/0179780 | A1 * | 8/2007 | Yamanashi et al. | 704/200.1 |

FOREIGN PATENT DOCUMENTS

| | | | |
|---|---|---|---|
| EP | 0942411 | A2 | 9/1999 |
| JP | 7-160297 | | 6/1995 |
| JP | 8-123490 | A | 5/1996 |
| JP | 8-123490 | | 6/1996 |
| JP | 11-327600 | | 11/1999 |
| JP | 2003-058196 | | 2/2003 |
| JP | 2003-058196 | A | 2/2003 |
| JP | 2002-323199 | | 11/2003 |
| JP | 2003-323199 | A | 11/2003 |
| WO | 03/091989 | | 11/2003 |

OTHER PUBLICATIONS

U.S. Appl. No. 11/429,944 to Morii et al., filed May 9, 2006.

Yonezaki et al., "Jikan Shuhasu Masking o Riyoshita Spectrum Horaku no Vector Ryoshika," The Acoustical Society of Japan (ASJ), Heisei 7 Nendo Shuki Kenkyu Happyokai Koen Ronbunshu—I—, Sep. 27, 1995, pp. 283-284.

Johnston, "Estimation of Perceptual Entropy Using Noise Masking Criteria," Proceedings ICASSP-88, May 1988, pp. 2524-2527.

English language Abstract of JP 8-123490 A.

English language Abstract of JP 2003-323199 A.

English language Abstract of JP 2003-058196 A.

English language partial translation of Yonezaki et al., "Jikan Shuhasu Masking o Riyoshita Spectrum Horaku no Vector Ryoshika," ("Vector Quantization of Spectrum Envelop Parameter Under Spectrum Temporol Masking"), The Acoustical Society of Japan (ASJ), Heisei 7 Nendo Shuki Kenkyu Happyokai Koen Ronbunshu—I—, Sep. 27, 1995, pp. 283-284.

English language translation of paragraphs [0013]—[0021] of JP 8-123490 A.

* cited by examiner

VOICE/MUSICAL SOUND ENCODING DEVICE AND VOICE/MUSICAL SOUND ENCODING METHOD

TECHNICAL FIELD

The present invention relates to a voice/musical tone coding apparatus and voice/musical tone coding method that perform voice/musical tone signal transmission in a packet communication system typified by Internet communication, a mobile communication system, or the like.

BACKGROUND ART

When a voice signal is transmitted in a packet communication system typified by Internet communication, a mobile communication system, or the like, compression and coding technology is used to increase transmission efficiency. To date, many voice coding methods have been developed, and many of the low bit rate voice coding methods developed in recent years have a scheme in which a voice signal is separated into spectrum information and detailed spectrum structure information, and compression and decoding is performed on the separated items.

Also, with the ongoing development of voice telephony environments on the Internet as typified by IP telephony, there is a growing need for technologies that efficiently compress and transfer voice signals.

In particular, various schemes relating to voice coding using human auditory masking characteristics are being studied. Auditory masking is the phenomenon whereby, when there is a strong signal component contained in a particular frequency, an adjacent frequency component cannot be heard, and this characteristic is used to improve quality.

An example of a technology related to this is the method described in Non-Patent Literature 1 that uses auditory masking characteristics in vector quantization distance calculation The voice coding method using auditory masking characteristics in Patent Literature 1 is a calculation method whereby, when a frequency component of an input signal and a code vector shown by a codebook are both in an auditory masking area, the distance in vector quantization is taken to be 0.

Patent Document 1: Japanese Patent Application Laid-Open No. HEI 8-123490 (p. 3, FIG. 1)

DISCLOSURE OF INVENTION

Problems to be Solved by the Invention

However, the conventional method shown in Patent Literature 1 can only be adapted to cases with limited input signals and code vectors, and sound quality performance is inadequate.

The present invention has been implemented taking into account the problems described above, and it is an object of the present invention to provide a high-quality voice/musical tone coding apparatus and voice/musical tone coding method that select a suitable code vector that minimizes degradation of a signal that has a large auditory effect.

Means for Solving the Problems

In order to solve the above problems, a voice/musical tone coding apparatus of the present invention has a configuration that includes: a quadrature transformation processing section that converts a voice/musical tone signal from time components to frequency components; an auditory masking characteristic value calculation section that finds an auditory masking characteristic value from the aforementioned voice/musical tone signal; and a vector quantization section that performs vector quantization changing an aforementioned frequency component and the calculation method of the distance between a code vector found from a preset codebook and the aforementioned frequency component based on the aforementioned auditory masking characteristic value.

Advantageous Effect of the Invention

According to the present invention, by performing quantization changing the method of calculating the distance between an input signal and code vector based on an auditory masking characteristic value, it is possible to select a suitable code vector that minimizes degradation of a signal that has a large auditory effect, and improve input signal reproducibility and obtain good decoded voice.

BEST MODE FOR CARRYING OUT THE INVENTION

Embodiments of the present invention will now be described in detail below with reference to the accompanying drawings.

Embodiment 1

Figure 1:
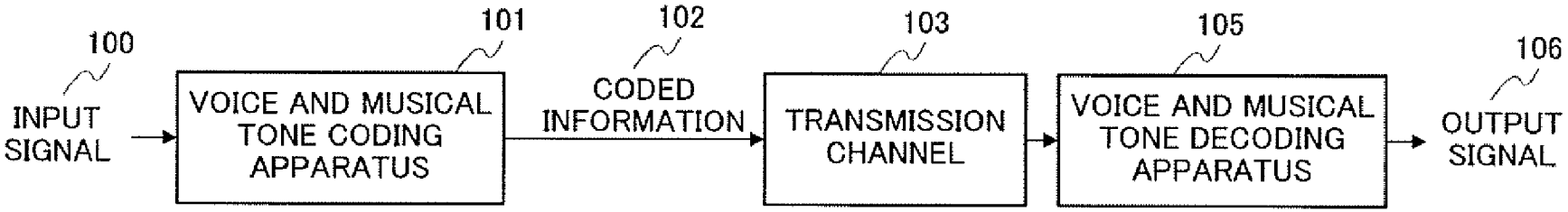
FIG. 1 is a block configuration diagram of an overall system that includes a voice/musical tone coding apparatus and voice/musical tone decoding apparatus according to Embodiment 1 of the present invention.

FIG. 1 is a block diagram showing the configuration of an overall system that includes a voice/musical tone coding apparatus and voice/musical tone decoding apparatus according to Embodiment 1 of the present invention.

This system is composed of voice/musical tone coding apparatus 101 that codes an input signal, transmission channel 103, and voice/musical tone decoding apparatus 105 that decodes.

Transmission channel 103 may be a wireless LAN, mobile terminal packet communication, Bluetooth, or suchlike radio communication channel, or may be an ADSL, FTTH, or suchlike cable communication channel.

Voice/musical tone coding apparatus 101 codes input signal 100, and outputs the result to transmission channel 103 as coded information 102.

voice/musical tone decoding apparatus 105 receives coded information 102 via transmission channel 103, performs decoding, and outputs the result as output signal 106.

Figure 2:
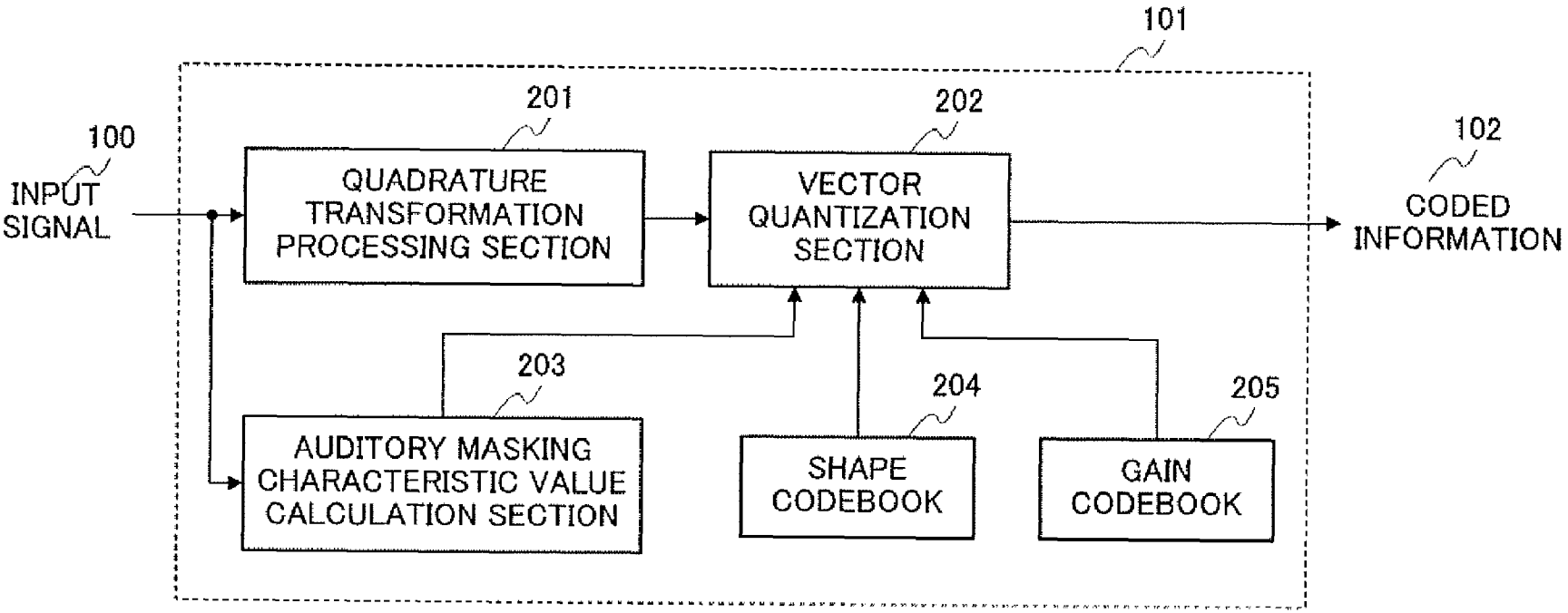
FIG. 2 is a block configuration diagram of a voice/musical tone coding apparatus according to Embodiment 1 of the present invention.

The configuration of voice/musical tone coding apparatus 101 will be described using the block diagram in FIG. 2. In FIG. 2, voice/musical tone coding apparatus 101 is mainly composed of: quadrature transformation processing section 201 that converts input signal 100 from time components to frequency components; auditory masking characteristic value calculation section 203 that calculates an auditory masking characteristic value from input signal 100; shape codebook 204 that shows the correspondence between an index and a normalized code vector; gain codebook 205 that relates to each normalized code vector of shape codebook 204 and shows its gain; and vector quantization section 202 that performs vector quantization of an input signal converted to the aforementioned frequency components using the aforementioned auditory masking characteristic value, and the aforementioned shape codebook and gain codebook.

The operation of voice/musical tone coding apparatus 101 will now be described in detail in accordance with the procedure in the flowchart in FIG. 16.

First, input signal sampling processing will be described. Voice/musical tone coding apparatus 101 divides input signal 100 into sections of N samples (where N is a natural number), takes N samples as one frame, and performs coding on a frame-by-frame. Here, input signal 100 subject to coding will be represented as $x_n$ (n=0, Λ, N−1), where n indicates that this is the n+1'th of the signal elements comprising the aforementioned divided input signal.

Input signal $x_n$ 100 is input to quadrature transformation processing section 201 and auditory masking characteristic value calculation section 203.

Quadrature transformation processing section 201 has internal buffers $buf_n$ (n=0, Λ, N−1) for the aforementioned signal elements, and initializes these with 0 as the initial value by means of Equation (1).

$$buf_n=0(n=0,\ldots,N-1) \qquad \text{[Equation 1]}$$

Quadrature transformation processing (step S1601) will now be described with regard to the calculation procedure in quadrature transformation processing section 201 and data output to an internal buffer.

Quadrature transformation processing section 201 performs a modified discrete cosine transform (MDCT) on input signal $x_n$ 100, and finds MDCT coefficient $X_k$ by means of Equation (2).

$$X_k = \frac{2}{N}\sum_{n=0}^{2N-1} x'_n \cos\left[\frac{(2n+1+N)(2k+1)\pi}{4N}\right] \qquad \text{[Equation 2]}$$

$$(k = 0, \ldots, N-1)$$

Here, k signifies the index of each sample in one frame. Quadrature transformation processing section 201 finds $x_n'$, which is a vector linking input signal $x_n$ 100 and buffer $buf_n$, by means of Equation (3).

$$x'_n = \begin{cases} buf_n & (n = 0, \ldots N-1) \\ x_{n-N} & (n = N, \ldots 2N-1) \end{cases} \qquad \text{[Equation 3]}$$

Quadrature transformation processing section 201 then updates buffer buff by means of Equation (4).

$$buf_n=x_n(n=0,\ldots N-1) \qquad \text{[Equation 4]}$$

Next, quadrature transformation processing section 201 outputs MDCT coefficient $X_k$ to vector quantization section 202.

The configuration of auditory masking characteristic value calculation section 203 in FIG. 2 will now be described using the block diagram in FIG. 3.

Figure 3:
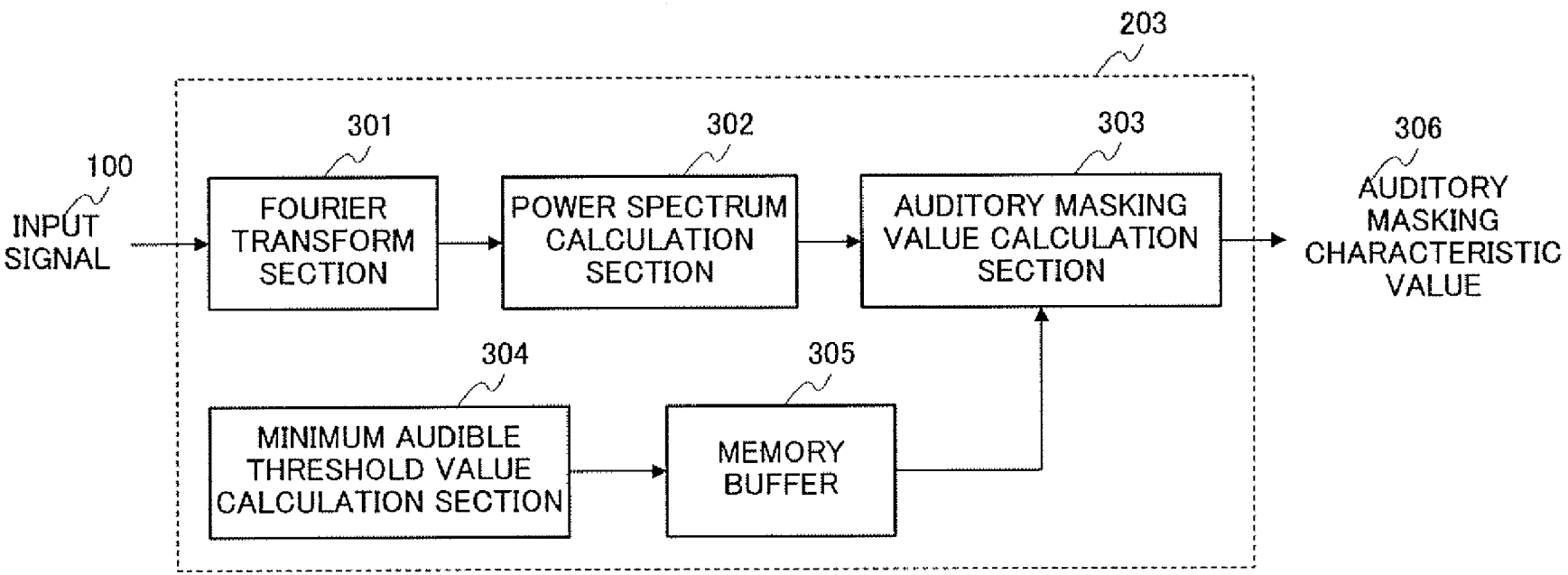
FIG. 3 is a block configuration diagram of an auditory masking characteristic value calculation section according to Embodiment 1 of the present invention.

In FIG. 3, auditory masking characteristic value calculation section 203 is composed of: Fourier transform section 301 that performs Fourier transform processing of an input signal; power spectrum calculation section 302 that calculates a power spectrum from the aforementioned Fourier transformed input signal; minimum audible threshold value calculation section 304 that calculates a minimum audible threshold value from an input signal; memory buffer 305 that buffers the aforementioned calculated minimum audible threshold value; and auditory masking value calculation section 303 that calculates an auditory masking value from the aforementioned calculated power spectrum and the aforementioned buffered minimum audible threshold value.

Figure 17:
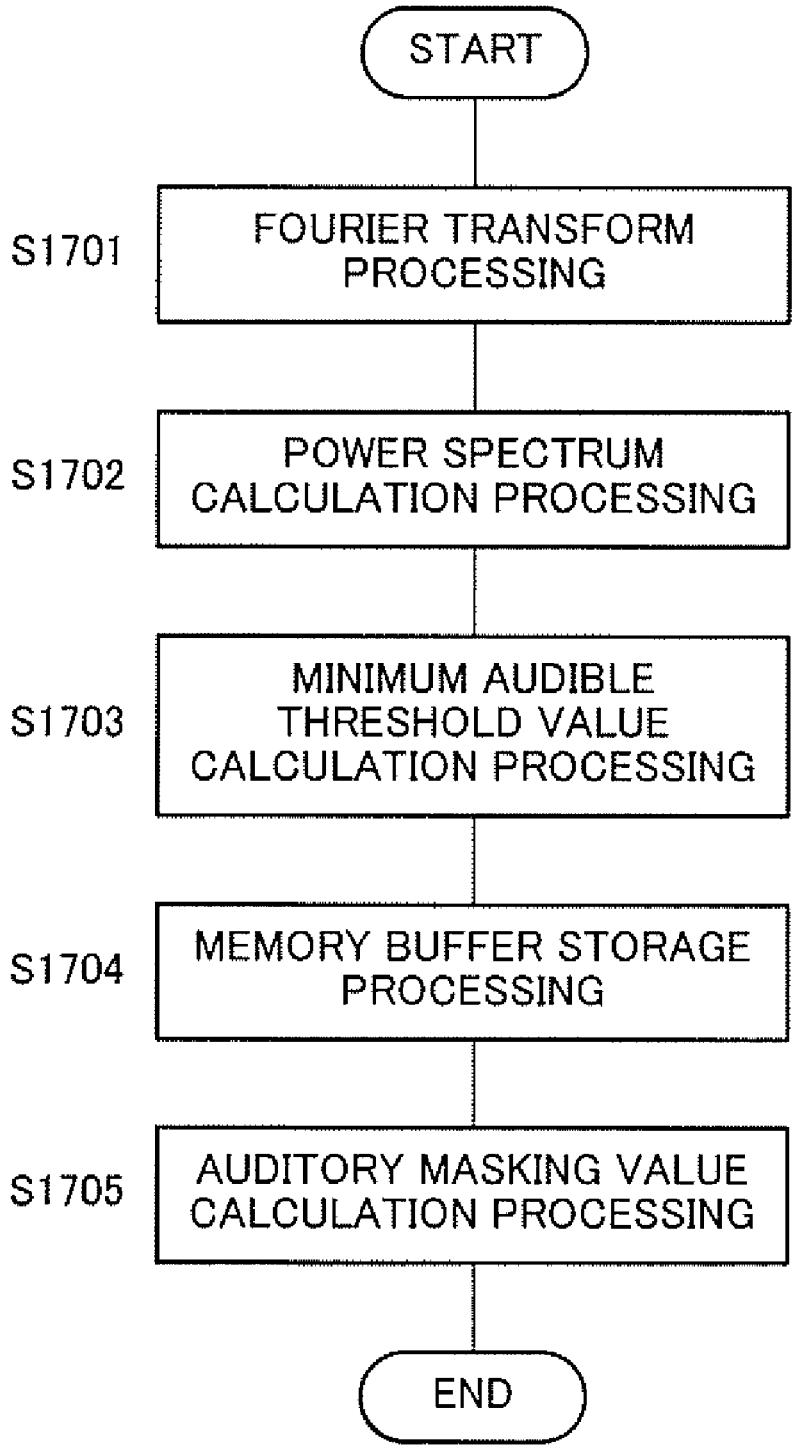
FIG. 17 is a flowchart of an auditory masking value calculation section according to Embodiment 1 of the present invention.

Next, auditory masking characteristic value calculation processing (step S1602) in auditory masking characteristic value calculation section 203 configured as described above will be explained using the flowchart in FIG. 17.

The auditory masking characteristic value calculation method is disclosed in a paper by Mr. J. Johnston et al (J. Johnston, "Estimation of perceptual entropy using noise masking criteria", in Proc. ICASSP-88, May 1988, pp. 2524-2527).

First, the operation of Fourier transform section 301 will be described with regard to Fourier transform processing (step S1701).

Fourier transform section 301 has input signal $x_n$ 100 as input, and converts this to a frequency domain signal $F_k$ by means of Equation (5). Here, e is the natural logarithm base, and k is the index of each sample in one frame.

$$F_k = \sum_{n=0}^{N-1} x_n e^{-j\frac{2\pi kn}{N}} \quad (k = 0, \ldots, N-1) \qquad \text{[Equation 5]}$$

Fourier transform section 301 then outputs obtained $F_k$ to power spectrum calculation section 302.

Next, power spectrum calculation processing (step S1702) will be described.

Power spectrum calculation section 302 has frequency domain signal $F_k$ output from Fourier transform section 301 as input, and finds power spectrum $P_k$ of $F_k$ by means of Equation (6). Here, k is the index of each sample in one frame.

$$P_k=(F_k^{Re})^2+(F_k^{Im})^2(k=0, \ldots, N-1) \qquad \text{[Equation 6]}$$

In Equation (6), $F_k^{Re}$ is the real part of frequency domain signal $F_k$, and is found by power spectrum calculation section 302 by means of Equation (7).

$$F_k^{\mathrm{Re}} = \sum_{n=0}^{N-1}\left[x_n \cos\left(\frac{2\pi kn}{N}\right)\right] \quad (k = 0, \ldots, N-1) \qquad \text{[Equation 7]}$$

Also, $F_k^{Im}$ is the imaginary part of frequency domain signal $F_k$, and is found by power spectrum calculation section 302 by means of Equation (8).

$$F_k^{\mathrm{Im}} = -\sum_{n=0}^{N-1}\left[x_n \sin\left(\frac{2\pi kn}{N}\right)\right] \quad (k = 0, \ldots, N-1) \qquad \text{[Equation 8]}$$

Power spectrum calculation section 302 then outputs obtained power spectrum $P_k$ to auditory masking value calculation section 303.

Next, minimum audible threshold value calculation processing (step S1703) will be described.

Minimum audible threshold value calculation section 304 finds minimum audible threshold value $ath_k$ in the first frame only by means of Equation (9).

$$ath_k=3.64(k/1000)^{-0.8}-6.5e^{-0.6(k/1000-3.3)^2}+10^{-3}(k/1000)^4(k=0, \ldots, N-1) \qquad \text{[Equation 9]}$$

Next, memory buffer storage processing (step S1704) will be described.

Minimum audible threshold value calculation section 304 outputs minimum audible threshold value $ath_k$ to memory buffer 305. Memory buffer 305 outputs input minimum audible threshold value $ath_k$ to auditory masking value calculation section 303. Minimum audible threshold value $ath_k$ is determined for each frequency component based on human hearing, and a component equal to or smaller than $ath_k$ is not audible.

Next, the operation of auditory masking value calculation section 303 will be described with regard to auditory masking value calculation processing (step S1705).

Figure 4:
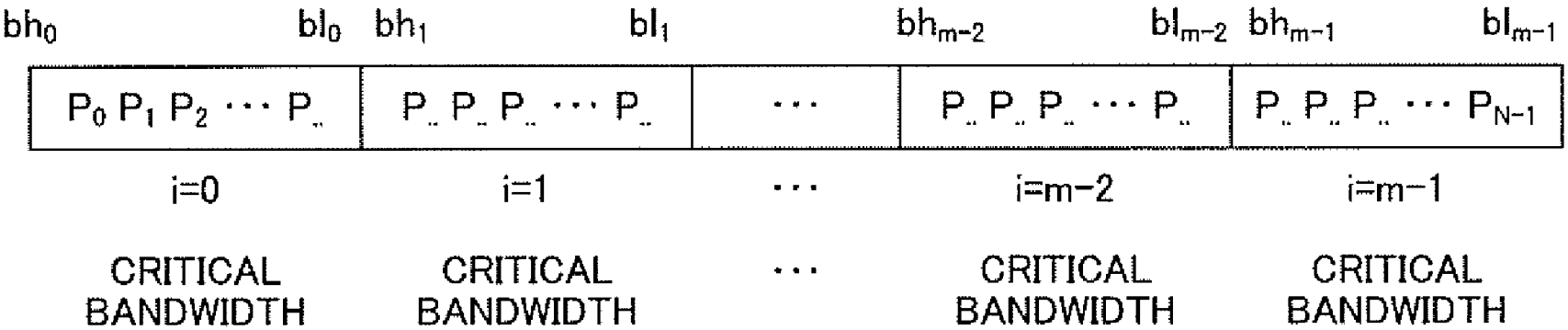
FIG. 4 is a drawing showing a sample configuration of critical bandwidths according to Embodiment 1 of the present invention.

Auditory masking value calculation section 303 has power spectrum $P_k$ output from power spectrum calculation section 302 as input, and divides power spectrum $P_k$ into m critical bandwidths. Here, a critical bandwidth is a threshold bandwidth for which the amount by which a pure tone of the center frequency is masked does not increase even if band noise is increased. FIG. 4 shows a sample critical bandwidth configuration. In FIG. 4, m is the total number of critical bandwidths, and power spectrum $P_k$ is divided into m critical bandwidths. Also, i is the critical bandwidth index, and has a value from 0 to m−1. Furthermore, $bh_i$ and $bl_i$ are the minimum frequency index and maximum frequency index of each critical bandwidth I, respectively.

Next, auditory masking value calculation section 303 has power spectrum $P_k$ output from power spectrum calculation section 302 as input, and finds power spectrum $B_i$ calculated for each critical bandwidth by means of Equation (10).

$$B_i = \sum_{k=bl_i}^{bh_i} P_k \quad (i = 0, \ldots, m-1) \qquad \text{[Equation 10]}$$

Auditory masking value calculation section 303 then finds spreading function SF(t) by means of Equation (11).

Spreading function SF(t) is used to calculate, for each frequency component, the effect (simultaneous masking effect) that that frequency component has on adjacent frequencies.

$$SF(t)=15.81139+7.5(t+0.474)-17.5\sqrt{1+(t+0.474)^2}(t=0, \ldots, N_t-1) \qquad \text{[Equation 11]}$$

Here, $N_t$ is a constant set beforehand within a range that satisfies the condition in Equation (12).

$$0 \leqq N_t \leqq m \qquad \text{[Equation 12]}$$

Next, auditory masking value calculation section 303 finds constant $C_i$ using power spectrum $B_i$ and spreading function SF(t) added for each critical bandwidth by means of Equation (13).

$$C_i = \begin{cases} \sum_{t=N_T-i}^{N_t} B_t \cdot SF(t) & (i < N_t) \\ \sum_{t=0}^{N_t} B_t \cdot SF(t) & (N_t \le i \le N - N_t) \\ \sum_{t=0}^{N-i_t} B_t \cdot SF(t) & (i > N - N_t) \end{cases} \qquad \text{[Equation 13]}$$

Auditory masking value calculation section 303 then finds geometric mean $\mu_i^9$ by means of Equation (14)

$$\mu_i^g = 10^{\frac{\log\left(\prod_{k=bh_i}^{bl_i} P_k\right)}{bl_i - bh_i}} \quad (i = 0, \ldots, m-1) \qquad \text{[Equation 14]}$$

Auditory masking value calculation section 303 then finds arithmetic mean $\mu_i^a$ by means of Equation (15)

$$\mu_i^g = \frac{\sum_{k=bh_i}^{bl_i} P_k}{(bl_i - bh_i)} \quad (i = 0, \ldots, m-1) \qquad \text{[Equation 15]}$$

Auditory masking value calculation section 303 then finds $SFM_i$ (Spectral Flatness Measure) by means of Equation (16).

$$SFM_i=\mu_i^g/\mu_i^a(i=0, \ldots, m-1) \qquad \text{[Equation 16]}$$

Auditory masking value calculation section 303 then finds constant $\alpha_i$ by means of Equation (17).

$$\alpha_1 = \min\left(\frac{10 \cdot \log_{10} SFM_i}{-60}, 1\right) \quad (i = 0, \ldots, m-1) \qquad \text{[Equation 17]}$$

Auditory masking value calculation section 303 then finds offset value $O_i$ for each critical bandwidth by means of Equation (18).

$$O_i = \alpha_i \cdot (14.5+i) + 5.5 \cdot (1-\alpha_i) \ (i=0, \ldots, m-1) \qquad \text{[Equation 18]}$$

Auditory masking value calculation section 303 then finds auditory masking value $T_i$ for each critical bandwidth by means of Equation (19).

$$T_i = \sqrt{10^{\log 10(C_i)-(O_i/10)}/(bl_i - bh_i)} (i=0, \ldots, m-1) \qquad \text{[Equation 19]}$$

Auditory masking value calculation section 303 then finds auditory masking characteristic value $M_k$ from minimum audible threshold value $ath_k$ output from memory buffer 305 by means of Equation (20), and outputs this to vector quantization section 202.

$$M_k = \max(ath_k, T_i)(k=bh_i, \ldots, bl_i, i=0, \ldots, m-1) \qquad \text{[Equation 20]}$$

Figure 5:
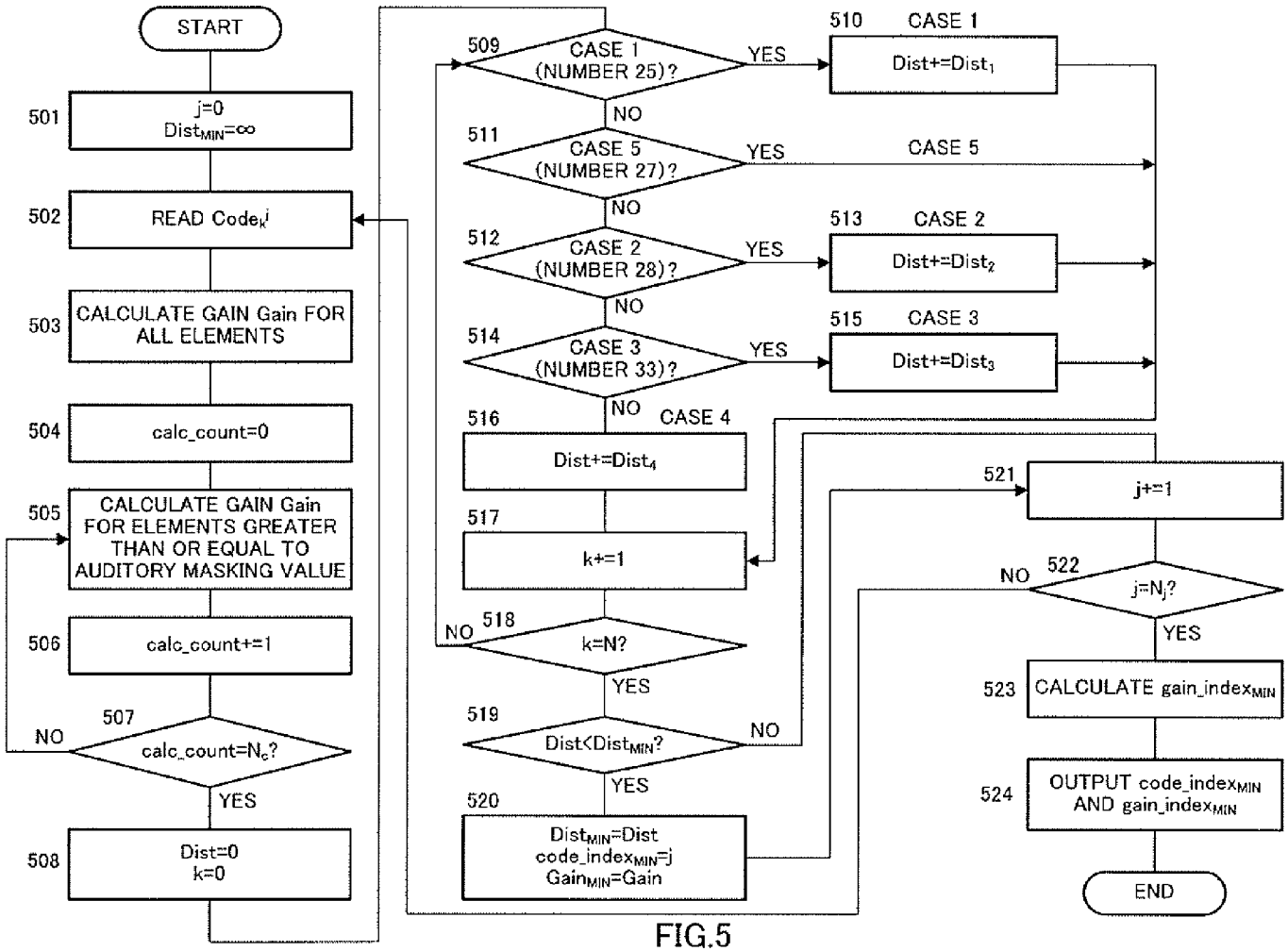
FIG. 5 is a flowchart of a vector quantization section according to Embodiment 1 of the present invention.

Next, codebook acquisition processing (step S1603) and vector quantization processing (step S1604) in vector quantization section 202 will be described in detail using the process flowchart in FIG. 5.

Using shape codebook 204 and gain codebook 205, vector quantization section 202 performs vector quantization of MDCT coefficient $X_k$ from MDCT coefficient $X_k$ output from quadrature transformation processing section 201 and an auditory masking characteristic value output from auditory masking characteristic value calculation section 203, and outputs obtained coded information 102 to transmission channel 103 in FIG. 1.

The codebooks will now be described.

Shape codebook 204 is composed of previously created $N_j$ kinds of N-dimensional code vectors $code_k^j$ (j=0, Λ, $N_j$−1, k=0, Λ, N−1), and gain codebook 205 is composed of previously created $N_d$ kinds of gain codes $gain^d$ (j=0, Λ, $N_d$−1).

In step 501, initialization is performed by assigning 0 to code vector index j in shape codebook 204, and a sufficiently large value to minimum error $Dist_{MIN}$.

In step 502, N-dimensional code vector $code_k^j$ (k=0, Λ, N−1) is read from shape codebook 204.

In step 503, MDCT coefficient $X_k$ output from quadrature transformation processing section 201 is input, and gain Gain of code vector $code_k^j$ (k=0, Λ, N−1) read in shape codebook 204 in step 502 is found by means of Equation (21).

$$\text{Gain} = \sum_{k=0}^{N-1} X_k \cdot code_k^j \Big/ \sum_{k=0}^{N-1} {code_k^j}^2 \qquad \text{[Equation 21]}$$

In step 504, 0 is assigned to calc_count indicating the number of executions of step 505.

In step 505, auditory masking characteristic value $M_k$ output from auditory masking characteristic value calculation section 203 is input, and temporary gain $temp_k$ (k=0, Λ, N−1) is found by means of Equation (22).

$$temp_k = \begin{cases} code_k^j & (|code_k^j \cdot \text{Gain}| \geq M_k) \\ 0 & (|code_k^j \cdot \text{Gain}| < M_k) \end{cases} \quad (k = 0, \ldots, N-1) \qquad \text{[Equation 22]}$$

In Equation (22), if k satisfies the condition $|code_k^j \cdot \text{Gain}| \geqq M_k$, $code_k^j$ is assigned to temporary gain $temp_k$, and if k satisfies the condition $|code_k^j \cdot \text{Gain}| < M_k$, 0 is assigned to temporary gain $temp_k$.

Then, in step 505, gain Gain for an element that is greater than or equal to the auditory masking value is found by means of Equation (23).

$$\text{Gain} = \frac{\sum_{k=0}^{N-1} X_k \cdot temp_k}{\sum_{k=0}^{N-1} temp_k^2} \quad (k = 0, \ldots, N-1) \qquad \text{[Equation 23]}$$

If temporary gain $temp_k$ is 0 for all k's, 0 is assigned to gain Gain. Also, coded value $R_k$ is found from gain Cain and $code_k^j$ by means of Equation (24).

$$R_k = \text{Gain} \cdot code_k^j (k=0, \ldots, N-1) \qquad \text{[Equation 24]}$$

In step 506, calc_count is incremented by 1.

In step 507, calc_count and a predetermined non-negative integer $N_c$ are compared, and the process flow returns to step 505 if calc_count is a smaller value than $N_c$, or proceeds to step 508 if calc_count is greater than or equal to $N_c$. By repeatedly finding gain Gain in this way, gain Gain can be converged to a suitable value.

In step 508, 0 is assigned to cumulative error Dist, and 0 is also assigned to sample index k.

Next, in steps 509, 511, 512, and 514, case determination is performed for the relative positional relationship between auditory masking characteristic value $M_k$, coded value $R_k$, and MDCT coefficient $X_k$, and distance calculation is performed in step 510, 513, 515, or 516 according to the case determination result.

Figure 6:
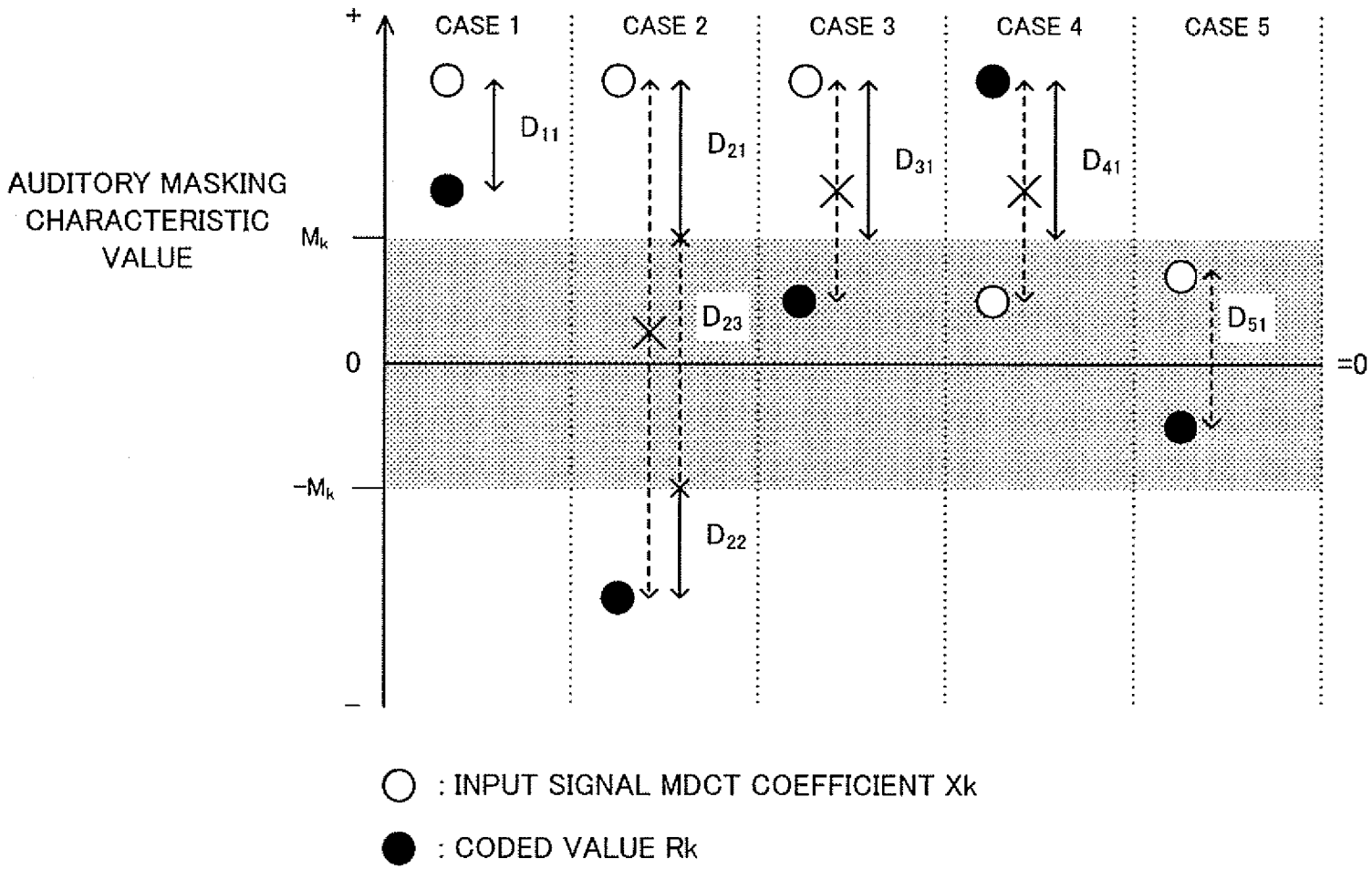
FIG. 6 is a drawing explaining the relative positional relationship of auditory masking characteristic values, coding values, and MDCT coefficients according to Embodiment 1 of the present invention.

This case determination according to the relative positional relationship is shown in FIG. 6. In FIG. 6, a white circle symbol (○) signifies an input signal MDCT coefficient $X_k$, and a black circle symbol (•) signifies a coded value $R_k$. The items shown in FIG. 6 show the special characteristics of the present invention, and the area from the auditory masking characteristic value found by auditory masking characteristic value calculation section 203 +$M_k$ to 0 to −$M_k$ is referred to as the auditory masking area, and high-quality results closer in terms of the sense of hearing can be obtained changing the distance calculation method when input signal MDCT coefficient $X_k$ or coded value $R_k$ is present in this auditory masking area.

The distance calculation method in vector quantization according to the present invention will now be described. When neither input signal MDCT coefficient $X_k$ (○) nor coded value $R_k$ (•) is present in the auditory masking area, and input signal MDCT coefficient $X_k$ and coded value $R_k$ are the same codes, as shown in "Case 1" in FIG. 6, distance $D_{11}$ between input signal MDCT coefficient $X_k$ (○) and coded value $R_k$ (•) is simply calculated. When one of input signal MDCT coefficient $X_k$ (○) and coded value $R_k$ (•) is present in the auditory masking area, as shown in "Case 3," and "Case 4" in FIG. 6, the position within the auditory masking area is corrected to an $M_k$ value (or in some cases a −$M_k$ value) and $D_{31}$ or $D_{41}$ is calculated. When input signal MDCT coefficient $X_k$ (○) and coded value $R_k$ (•) straddle the auditory masking area, as shown in "Case 2" in FIG. 6, the inter-auditory-masking-area distance is calculated as $\beta \cdot D_{23}$ (where β is an arbitrary coefficient). When input signal MDCT coefficient $X_k$ (○) and coded value $R_k$ (•) are both present within the auditory masking area, as shown in "Case 5" in FIG. 6, distance $D_{51}$ is calculated as 0.

Next, processing in step 509 through step 517 for each of the cases will be described.

In step 509, whether or not the relative positional relationship between auditory masking characteristic value $M_k$, coded value $R_k$, and MDCT coefficient $X_k$ corresponds to "Case 1" in FIG. 6 is determined by means of the conditional expression in Equation (25).

$$(|X_k| \geqq M_k) \text{ and } (|R_k| \geqq M_k) \text{ and } (X_k \cdot R_k \geqq 0) \quad \text{[Equation 25]}$$

Equation (25) signifies a case in which the absolute value of MDCT coefficient $X_k$ and the absolute value of coded value $R_k$ are both greater than or equal to auditory masking characteristic value $M_k$, and MDCT coefficient $X_k$ and coded value $R_k$ are the same codes. If auditory masking characteristic value $M_k$, MDCT coefficient $X_k$, and coded value $R_k$ satisfy the conditional expression in Equation (25), the process flow proceeds to step 510, and if they do not satisfy the conditional expression in Equation (25), the process flow proceeds to step 511.

In step 510, error $Dist_1$ between coded value $R_k$ and MDCT coefficient $X_k$ is found by means of Equation (26), error $Dist_1$ is added to cumulative error Dist, and the process flow proceeds to step 517.

$$Dist_1 = D_{11} = |X_k - R_k| \quad \text{[Equation 26]}$$

In step 511, whether or not the relative positional relationship between auditory masking characteristic value $M_k$, coded value $R_k$, and MDCT coefficient $X_k$ corresponds to "Case 5" in FIG. 6 is determined by means of the conditional expression in Equation (27).

$$(|X_k| \leqq M_k) \text{ and } (|R_k| < M_k) \quad \text{[Equation 27]}$$

Equation (27) signifies a case in which the absolute value of MDCT coefficient $X_k$ and the absolute value of coded value $R_k$ are both less than or equal to auditory masking characteristic value $M_k$. If auditory masking characteristic value $M_k$, MDCT coefficient $X_k$, and coded value $R_k$ satisfy the conditional expression in Equation (27), the error between coded value $R_k$ and MDCT coefficient $X_k$ is taken to be 0, nothing is added to cumulative error Dist, and the process flow proceeds to step 517, whereas if they do not satisfy the conditional expression in Equation (27), the process flow proceeds to step 512.

In step 512, whether or not the relative positional relationship between auditory masking characteristic value $M_k$, coded value $R_k$, and MDCT coefficient $X_k$ corresponds to "Case 2" in FIG. 6 is determined by means of the conditional expression in Equation (28).

$$(|X_k| \geqq M_k) \text{ and } (|R_k| \geqq M_k) \text{ and } (X_k \cdot R_k \geqq 0) \quad \text{[Equation 28]}$$

Equation (28) signifies a case in which the absolute value of MDCT coefficient $X_k$ and the absolute value of coded value $R_k$ are both greater than or equal to auditory masking characteristic value $M_k$, and MDCT coefficient $X_k$ and coded value $R_k$ are different codes. If auditory masking characteristic value $M_k$, MDCT coefficient $X_k$, and coded value $R_k$ satisfy the conditional expression in Equation (28), the process flow proceeds to step 513, and if they do not satisfy the conditional expression in Equation (28), the process flow proceeds to step 514.

In step 513, error $Dist_2$ between coded value $R_k$ and MDCT coefficient $X_k$ is found by means of Equation (29), error $Dist_2$ is added to cumulative error Dist, and the process flow proceeds to step 517.

$$Dist_2 = D_{21} + D_{22} + \beta * D_{23} \quad \text{[Equation 29]}$$

Here, β is value set as appropriate according to MDCT coefficient $X_k$, coded value $R_k$, and auditory masking characteristic value $M_k$. A value of 1 or less is suitable for β, and a numeric value found experimentally by subject evaluation may be used. $D_{21}$, $D_{22}$, and $D_{23}$ are found by means of Equation (30), Equation (31), and Equation (32) respectively.

$$D_{21} = |X_k| - M_k \quad \text{[Equation 30]}$$

$$D_{22} = R_k - M_k \quad \text{[Equation 31]}$$

$$D_{23} = M_k \cdot 2 \quad \text{[Equation 32]}$$

In step 514, whether or not the relative positional relationship between auditory masking characteristic value $M_k$, coded value $R_k$, and MDCT coefficient $X_k$ corresponds to "Case 3" in FIG. 6 is determined by means of the conditional expression in Equation (33).

$$(|X_k| \geqq M_k) \text{ and } (|R_k| < M_k) \quad \text{[Equation 33]}$$

Equation (33) signifies a case in which the absolute value of MDCT coefficient $X_k$ is greater than or equal to auditory masking characteristic value $M_k$, and coded value $R_k$ is less than auditory masking characteristic value $M_k$. If auditory masking characteristic value $M_k$, MDCT coefficient $X_k$, and coded value $R_k$ satisfy the conditional expression in Equation (33), the process flow proceeds to step 515, and if they do not satisfy the conditional expression in Equation (33), the process flow proceeds to step 516.

In step 515, error $Dist_3$ between coded value $R_k$ and MDCT coefficient $X_k$ is found by means of Equation (34), error $Dist_3$ is added to cumulative error Dist, and the process flow proceeds to step 517.

$$Dist_3 = D_{31} = |X_k| - M_k \quad \text{[Equation 34]}$$

In step 516, the relative positional relationship between auditory masking characteristic value $M_k$, coded value $R_k$, and MDCT coefficient $X_k$ corresponds to "Case 4" in FIG. 6, and the conditional expression in Equation (35) is satisfied.

$$(|X_k| < M_k) \text{ and } (|R_k| \geqq M_k) \quad \text{[Equation 35]}$$

Equation (35) signifies a case in which the absolute value of MDCT coefficient $X_k$ is less than auditory masking characteristic value $M_k$, and coded value $R_k$ is greater than or equal to auditory masking characteristic value $M_k$. In step 516, error $Dist_4$ between coded value $R_k$ and MDCT coefficient $X_k$ is found by means of Equation (36), error $Dist_4$ is added to cumulative error Dist, and the process flow proceeds to step 517.

$$Dist_4 = D_{41} = |R_k| - M_k \quad \text{[Equation 36]}$$

In step 517, k is incremented by 1.

In step 518, N and k are compared, and if k is a smaller value than N, the process flow returns to step 509. If k has the same value as N, the process flow proceeds to step 519.

In step 519, cumulative error Dist and minimum error $Dist_{MIN}$ are compared, and if cumulative error Dist is a smaller value than minimum error $Dist_{MIN}$, the process flow proceeds to step 520, whereas if cumulative error Dist is greater than or equal to minimum error $Dist_{MIN}$, the process flow proceeds to step 521.

In step 520, cumulative error Dist is assigned to minimum error $Dist_{MIN}$, j is assigned to $code_index_{MIN}$, and gain Gain is assigned to error minimum gain $Dist_{MIN}$, and the process flow proceeds to step 521.

In step 521, j is incremented by 1.

In step 522, total number of vectors $N_j$ and j are compared, and if j is a smaller value than $N_j$, the process flow returns to step 502. If j is greater than or equal to $N_j$, the process flow proceeds to step 523, In step 523, $N_d$ kinds of gain code $gain^d$ (d=0, Λ, $N_d$−1) are read from gain codebook 205, and quantization gain error $gainerr^d$ (d=0, Λ, $N_d$−1) is found by means of Equation (37) for all d's.

$$gainerr^d=|Gain_{MIN}-gain^d|(d=0, \ldots, N_d-1) \quad \text{[Equation 37]}$$

Then, in step 523, d for which quantization gain error $gainerr^d$ (d=0, Λ, $N_d$−1) is a minimum is found, and the found d is assigned to $gain_index_{MIN}$.

In step 524, $code_index_{MIN}$ that is the code vector index for which cumulative error Dist is a minimum, and $gain_index_{MIN}$ found in step 523, are output to transmission channel 103 in FIG. 1 as coded information 102, and processing is terminated.

This completes the description of coding section 101 processing.

Figure 7:
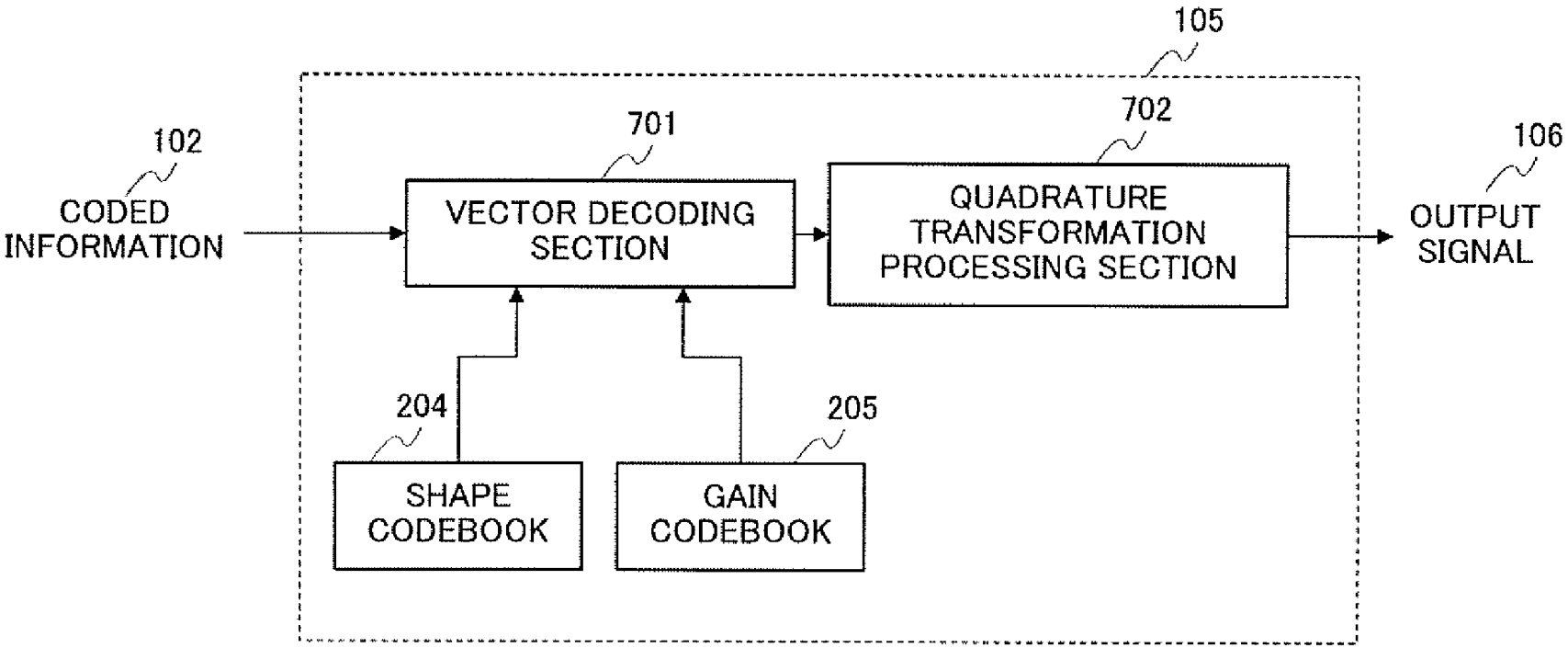
FIG. 7 is a block configuration diagram of a voice/musical tone decoding apparatus according to Embodiment 1 of the present invention.

Next, voice/musical tone decoding apparatus 105 in FIG. 1 will be described using the detailed block diagram in FIG. 7.

Shape codebook 204 and gain codebook 205 are the same as those shown in FIG. 2.

Vector decoding section 701 has coded information 102 transmitted via transmission channel 103 as input, and using $code_index_{MIN}$ and $gain_index_{MIN}$ as the coded information, reads code vector $codek^{code_indexMIN}$ (k=0, Λ, N−1) from shape codebook 204, and also reads gain code $gain^{gain_indexMIN}$ from gain codebook 205. Then vector decoding section 701 multiplies $gain^{gain_indexMIN}$ by $codek^{code_indexMIN}$ (k=0, Λ, N−1), and outputs $gain^{gain_indexMIN} \times codek^{code_indexMIN}$ (k=0, Λ, N−1) obtained as a result of the multiplication to quadrature transformation processing section 702 as a decoded MDCT coefficient.

Quadrature transformation processing section 702 has an internal buffer $buf_k'$, and initializes this buffer in accordance with Equation (38).

$$buf'_k=0(k=0, \ldots, N-1) \quad \text{[Equation 38]}$$

Next, decoded MDCT coefficient $gain^{gain_indexMIN} \times codek^{code_indexMIN}$ (k=0, Λ, N−1) output from MDCT coefficient decoding section 701 is input, and decoded signal $Y_n$ is found by means of Equation (39).

$$y_n = \frac{2}{N}\sum_{k=0}^{2N-1} X'_k \cos\left[\frac{(2n+1+N)(2k+1)\pi}{4N}\right] \quad \text{[Equation 39]}$$

$$(n = 0, \ldots, N-1)$$

Here, $X_k'$ is a vector linking decoded MDCT coefficient $gain^{gain_indexMIN} \times codek^{code_indexMIN}$ (k=0, Λ, N−1) and buffer $buf_k'$, and is found by means of Equation (40).

$$X'_k = \begin{cases} buf'_k & (k = 0, \ldots N-1) \\ gain^{gain_index_{MIN}} \; code_{k-N}^{code_index_{MIN}} & (k = N, \ldots 2N-1) \end{cases} \quad \text{[Equation 40]}$$

Buffer $buf_k'$ is then updated by means of Equation (41).

$$buf'_k=gain^{gain_indexMIN} \cdot code_k^{code_indexMIN}(k=0, \ldots, N-1) \quad \text{[Equation 41]}$$

Decoded signal $Y_n$ is then output as output signal 106.

By thus providing a quadrature transformation processing section that finds an input signal MDCT coefficient, an auditory masking characteristic value calculation section that finds an auditory masking characteristic value, and a vector quantization section that performs vector quantization using an auditory masking characteristic value, and performing vector quantization distance calculation according to the relative positional relationship between an auditory masking characteristic value, MDCT coefficient, and quantized MDCT coefficient, it is possible to select a suitable code vector that minimizes degradation of a signal that has a large auditory effect, and to obtain a high-quality output signal.

It is also possible to perform quantization in vector quantization section 202 by applying acoustic weighting filters for the distance calculations in above-described Case 1 through Case 5.

Also, in this embodiment, a case has been described in which MDCT coefficient coding is performed, but the present invention can also be applied, and the same kind of actions and effects can be obtained, in a case in which post-transformation signal (frequency parameter) coding is performed using Fourier transform, discrete cosine transform (DCT), or quadrature mirror filter (QMF) or suchlike quadrature transformation, Furthermore, in this embodiment, a case has been described in which coding is performed by means of vector quantization, but there are no restrictions on the coding method in the present invention, and, for example, coding may also be performed by means of divided vector quantization or multi-stage vector quantization.

Figure 16:
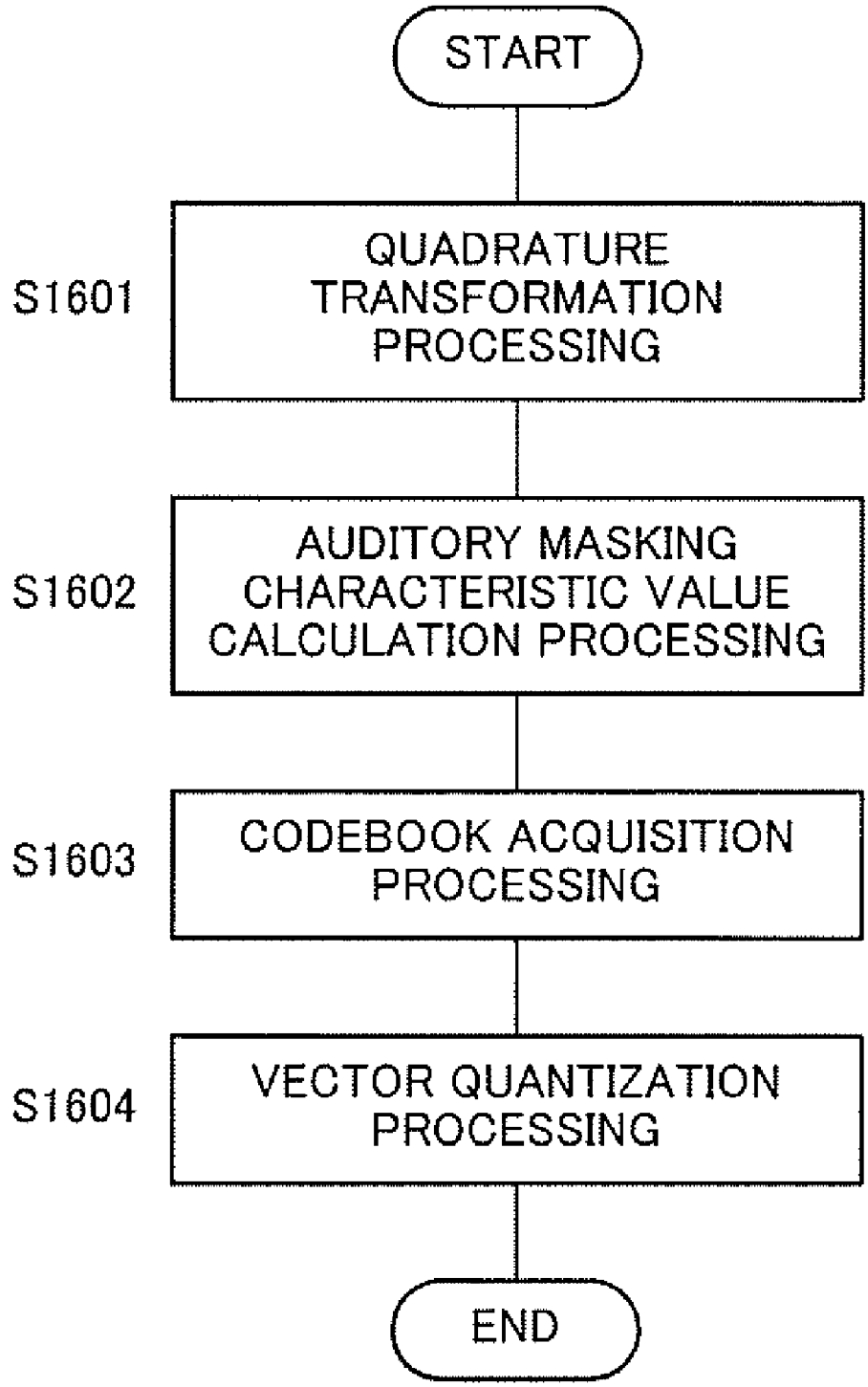
FIG. 16 is a flowchart of a coding section according to Embodiment 1 of the present invention.

It is also possible for voice/musical tone coding apparatus 101 to have the procedure shown in the flowchart in FIG. 16 executed by a computer by means of a program.

As described above, by calculating an auditory masking characteristic value from an input signal, considering all relative positional relationships of MDCT coefficient, coded value, and auditory masking characteristic value, and applying a distance calculation method suited to human hearing, it is possible to select a suitable code vector that minimizes degradation of a signal that has a large auditory effect, and to obtain good decoded voice even when an input signal is decoded at a low bit rate.

In Patent Literature 1, only "Case 5" in FIG. 6 is disclosed, but with the present invention, in addition to this, by employing a distance calculation method that takes an auditory masking characteristic value into consideration for all combinations of relationships as shown in "Case 2," "Case 3," and "Case 4," considering all relative positional relationships of input signal MDCT coefficient, coded value, and auditory masking characteristic value, and applying a distance calculation method suited to hearing, it is possible to obtain higher-quality coded voice even when an input signal is quantized at a low bit rate.

Also, the present invention is based on the fact that actual audibility differs if distance calculation is performed without change and vector quantization is then performed when an input signal MDCT coefficient or coded value is present within the auditory masking area, and when present on either side of the auditory masking area, and therefore more natural audibility can be provided changing the distance calculation method when performing vector quantization.

Embodiment 2

In Embodiment 2 of the present invention, an example is described in which vector quantization using the auditory masking characteristic values described in Embodiment 1 is applied to scalable coding.

In this embodiment, a case is described below in which, in a two-layer voice coding and decoding method composed of a base layer and enhancement layer, vector quantization is performed using auditory masking characteristic value in the enhancement layer.

A scalable voice coding method is a method whereby a voice signal is split into a plurality of layers based on frequency characteristics and coding is performed. Specifically, signals of each layer are calculated using a residual signal representing the difference between a lower layer input signal and a lower layer output signal. On the decoding side, the signals of these layers are added and a voice signal is decoded. This technique enables sound quality to be controlled flexibly, and also makes noise-tolerant voice signal transfer possible.

In this embodiment, a case in which the base layer performs CELP type voice coding and decoding will be described as an example.

Figure 8:
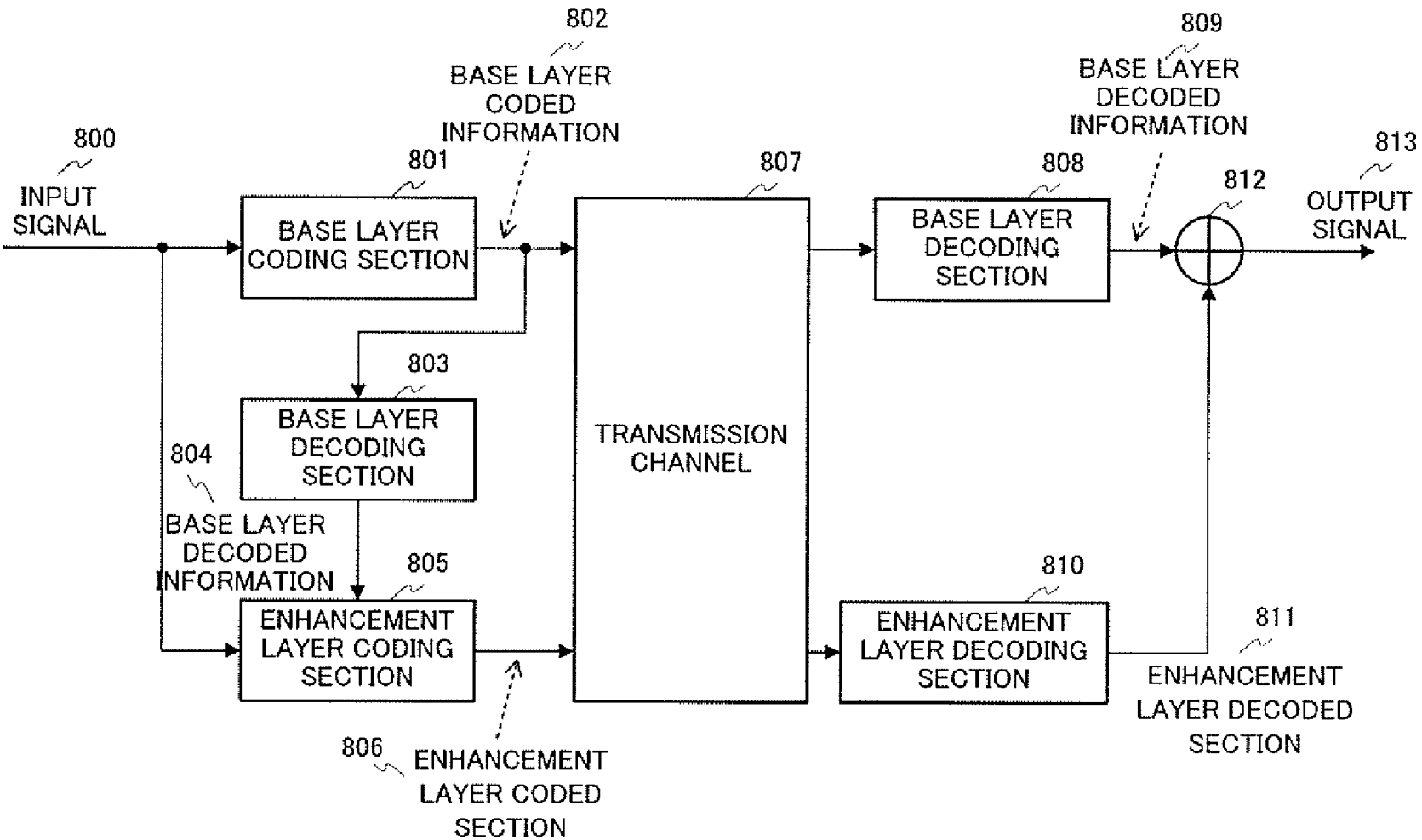
FIG. 8 is a block configuration diagram of a voice/musical tone coding apparatus and voice/musical tone decoding apparatus according to Embodiment 2 of the present invention.

FIG. 8 is a block diagram showing the configuration of a coding apparatus and decoding apparatus that use an MDCT coefficient vector quantization method according to Embodiment 2 of the present invention. In FIG. 8, the coding apparatus is composed of base layer coding section 801, base layer decoding section 803, and enhancement layer coding section 805, and the decoding apparatus is composed of base layer decoding section 808, enhancement layer decoding section 810, and adding section 812.

Base layer coding section 801 codes an input signal 800 using a CELP type voice coding method, calculates base layer coded information 802, and outputs this to base layer decoding section 803, and to base layer decoding section 808 via transmission channel 807.

Base layer decoding section 803 decodes base layer coded information 802 using a CELP type voice decoding method, calculates base layer decoded signal 804, and outputs this to enhancement layer coding section 805.

Enhancement layer coding section 805 has base layer decoded signal 804 output by base layer decoding section 803, and input signal 800, as input, codes the residual signal of input signal 800 and base layer decoded signal 804 by means of vector quantization using an auditory masking characteristic value, and outputs enhancement layer coded information 806 found by means of quantization to enhancement layer decoding section 810 via transmission channel 807. Details of enhancement layer coding section 805 will be given later herein.

Base layer decoding section 808 decodes base layer coded information 802 using a CELP type voice decoding method, and outputs a base layer decoded signal 809 found by decoding to adding section 812.

Enhancement layer decoding section 810 decodes enhancement layer coded information 806, and outputs enhancement layer decoded signal 811 found by decoding to adding section 812.

Adding section 812 adds together base layer decoded signal 809 output from base layer decoding section 808 and enhancement layer decoded signal 811 output from enhancement layer decoding section 810, and outputs the voice/musical tone signal that is the addition result as output signal 813.

Figure 9:
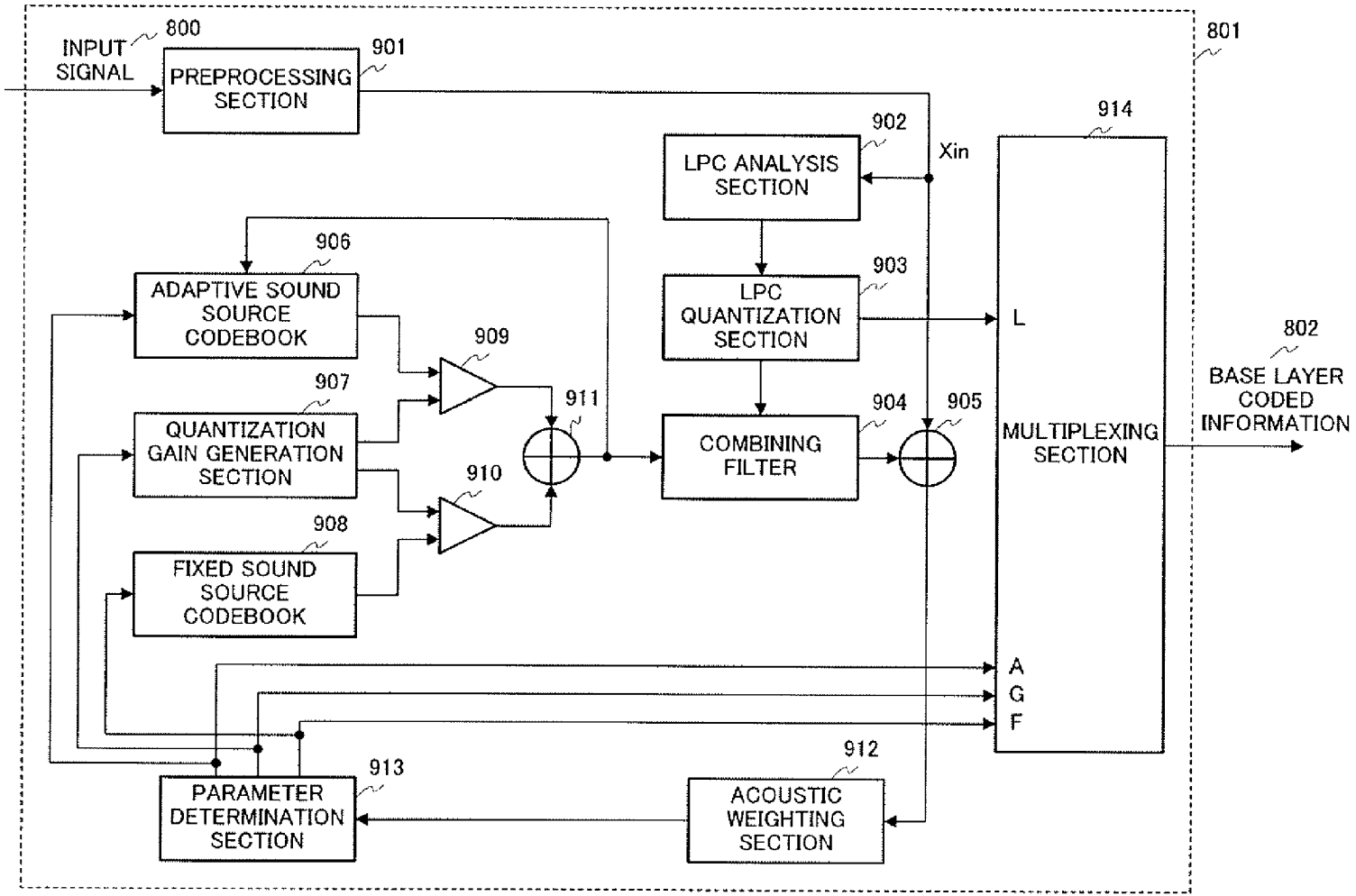
FIG. 9 is a schematic configuration diagram of a CELP type voice coding apparatus according to Embodiment 2 of the present invention.

Next, base layer coding section 801 will be described using the block diagram in FIG. 9.

Input signal 800 of base layer coding section 801 is input to a preprocessing section 901. Preprocessing section 901 performs high pass filter processing that removes a DC component, and waveform shaping processing and pre-emphasis processing aiming at performance improvement of subsequent coding processing, and outputs the signal (Xin) that has undergone this processing to LPC analysis section 902 and adding section 905.

LPC analysis section 902 performs linear prediction analysis using Xin, and outputs the analysis result (linear prediction coefficient) to LPC quantization section 903, LPC quantization section 903 performs quantization processing of the linear prediction coefficient (LPC) output from LPC analysis section 902, outputs the quantized LPC to combining filter 904, and also outputs a code (L) indicating the quantized LPC to multiplexing section 914.

Using a filter coefficient based on the quantized LPC, combining filter 904 generates a composite signal by performing filter combining on a drive sound source output from an adding section 911 described later herein, and outputs the composite signal to adding section 905.

Adding section 905 calculates an error signal by inverting the polarity of the composite signal and adding it to Xin, and outputs the error signal to acoustic weighting section 912.

Adaptive sound source codebook 906 stores a drive sound source output by adding section 911 in a buffer, extracts one frame's worth of samples from a past drive sound source specified by a signal output from parameter determination section 913 as an adaptive sound source vector, and outputs this to multiplication section 909.

Quantization gain generation section 907 outputs quantization adaptive sound source gain specified by a signal output from parameter determination section 913 and quantization fixed sound source gain to multiplication section 909 and a multiplication section 910, respectively.

Fixed sound source codebook 908 multiplies a pulse sound source vector having a form specified by a signal output from parameter determination section 913 by a spreading vector, and outputs the obtained fixed sound source vector to multiplication section 910.

Multiplication section 909 multiplies quantization adaptive sound source gain output from quantization gain generation section 907 by the adaptive sound source vector output from adaptive sound source codebook 906, and outputs the result to adding section 911. Multiplication section 910 multiplies the quantization fixed sound source gain output from quantization gain generation section 907 by the fixed sound source vector output from fixed sound source codebook 908, and outputs the result to adding section 911.

Adding section 911 has as input the post-gain-multiplication adaptive sound source vector and fixed sound source vector from multiplication section 909 and multiplication section 910 respectively, and outputs the drive sound source that is the addition result to combining filter 904 and adaptive sound source codebook 906. The drive sound source input to adaptive sound source codebook 906 is stored in a buffer.

Acoustic weighting section 912 performs acoustic weighting on the error signal output from adding section 905, and outputs the result to parameter determination section 913 as coding distortion.

Parameter determination section 913 selects from adaptive sound source codebook 906, fixed sound source codebook 908, and quantization gain generation section 907, the adaptive sound source vector, fixed sound source vector, and quantization gain that minimize coding distortion output from acoustic weighting section 912, and outputs an adaptive sound source vector code (A), sound source gain code (G), and fixed sound source vector code (F) indicating the selection results to multiplexing section 914.

Multiplexing section 914 has a code (L) indicating quantized LPC as input from LPC quantization section 903, and code (A) indicating an adaptive sound source vector, code (F)

indicating a fixed sound source vector, and code (G) indicating quantization gain as input from parameter determination section 913, multiplexes this information, and outputs the result as base layer coded information 802.

Base layer decoding section 803 (808) will now be described using FIG. 10.

Figure 10:
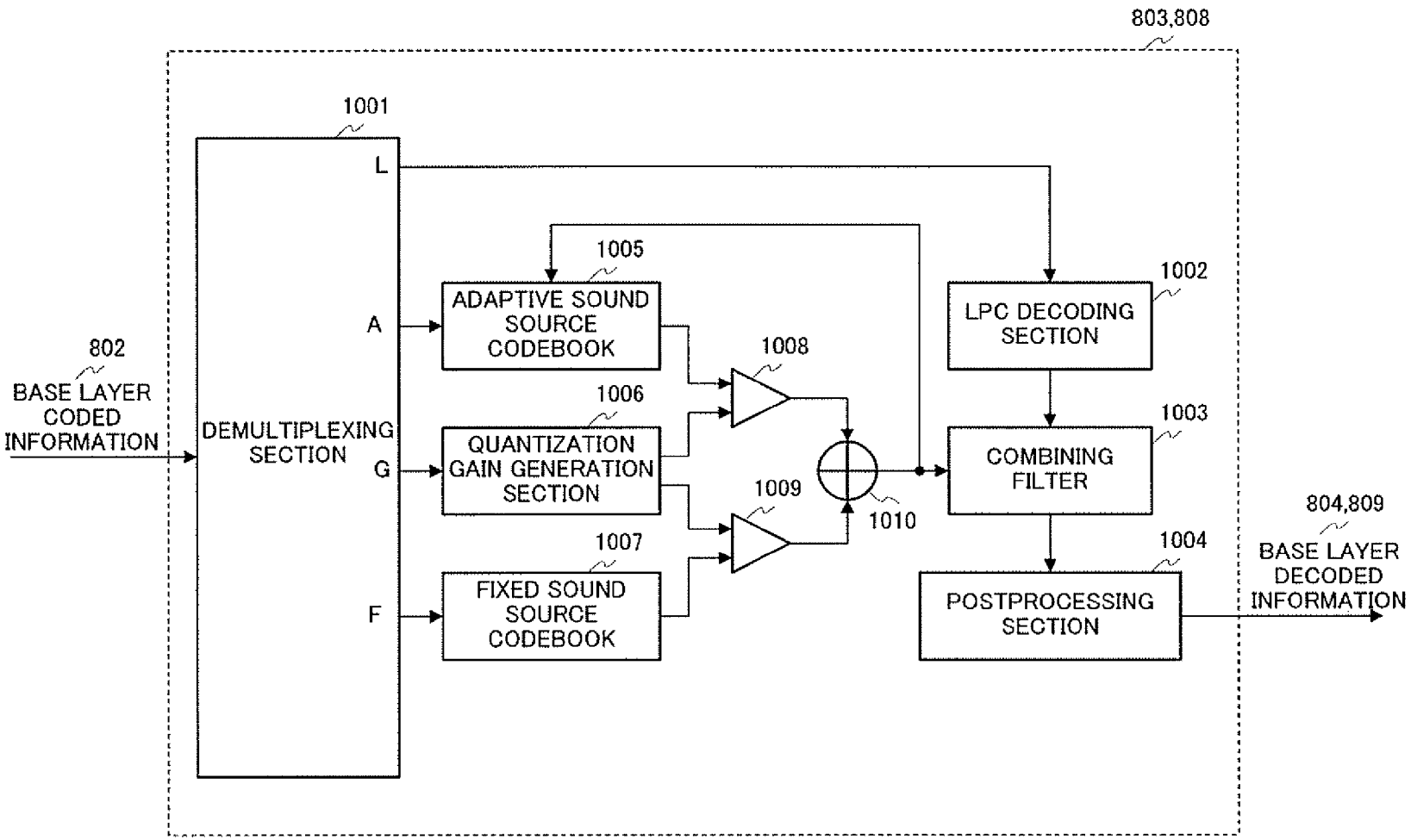
FIG. 10 is a schematic configuration diagram of a CELP type voice decoding apparatus according to Embodiment 2 of the present invention.

In FIG. 10, base layer coded information 802 input to base layer decoding section 803 (808) is separated into individual codes (L, A, G, F) by demultiplexing section 1001. Separated LPC code (L) is output to LPC decoding section 1002, separated adaptive sound source vector code (A) is output to adaptive sound source codebook 1005, separated sound source gain code (G) is output to quantization gain generation section 1006, and separated fixed sound source vector code (F) is output to fixed sound source codebook 1007.

LPC decoding section 1002 decodes a quantized LPC from code (L) output from demultiplexing section 1001, and outputs the result to combining filter 1003.

Adaptive sound source codebook 1005 extracts one frame's worth of samples from a past drive sound source designated by code (A) output from demultiplexing section 1001 as an adaptive sound source vector, and outputs this to multiplication section 1008.

Quantization gain generation section 1106 decodes quantization adaptive sound source gain and quantization fixed sound source gain designated by sound source gain code (G) output from demultiplexing section 1001, and outputs this to multiplication section 1008 and multiplication section 1009.

Fixed sound source codebook 1007 generates a fixed sound source vector designated by code (F) output from demultiplexing section 1001, and outputs this to multiplication section 1009.

Multiplication section 1008 multiplies the adaptive sound source vector by the quantization adaptive sound source gain, and outputs the result to adding section 1010. Multiplication section 1009 multiplies the fixed sound source vector by the quantization fixed sound source gain, and outputs the result to adding section 1010.

Adding section 1010 performs addition of the post-gain-multiplication adaptive sound source vector and fixed sound source vector output from multiplication section 1008 and multiplication section 1009, generates a drive sound source, and outputs this to combining filter 1003 and adaptive sound source codebook 1005.

Using the filter coefficient decoded by LPC decoding section 1002, combining filter 1003 performs filter combining of the drive sound source output from adding section 1010, and outputs the combined signal to postprocessing section 1004.

Postprocessing section 1004 executes, on the signal output from combining filter 1003, processing that improves the subjective voice sound quality such as formant emphasis and pitch emphasis, processing that improves the subjective sound quality of stationary noise, and so forth, and outputs the resulting signal as base layer decoded signal 804 (810).

Enhancement layer coding section 805 will now be described using FIG. 11.

Figure 11:
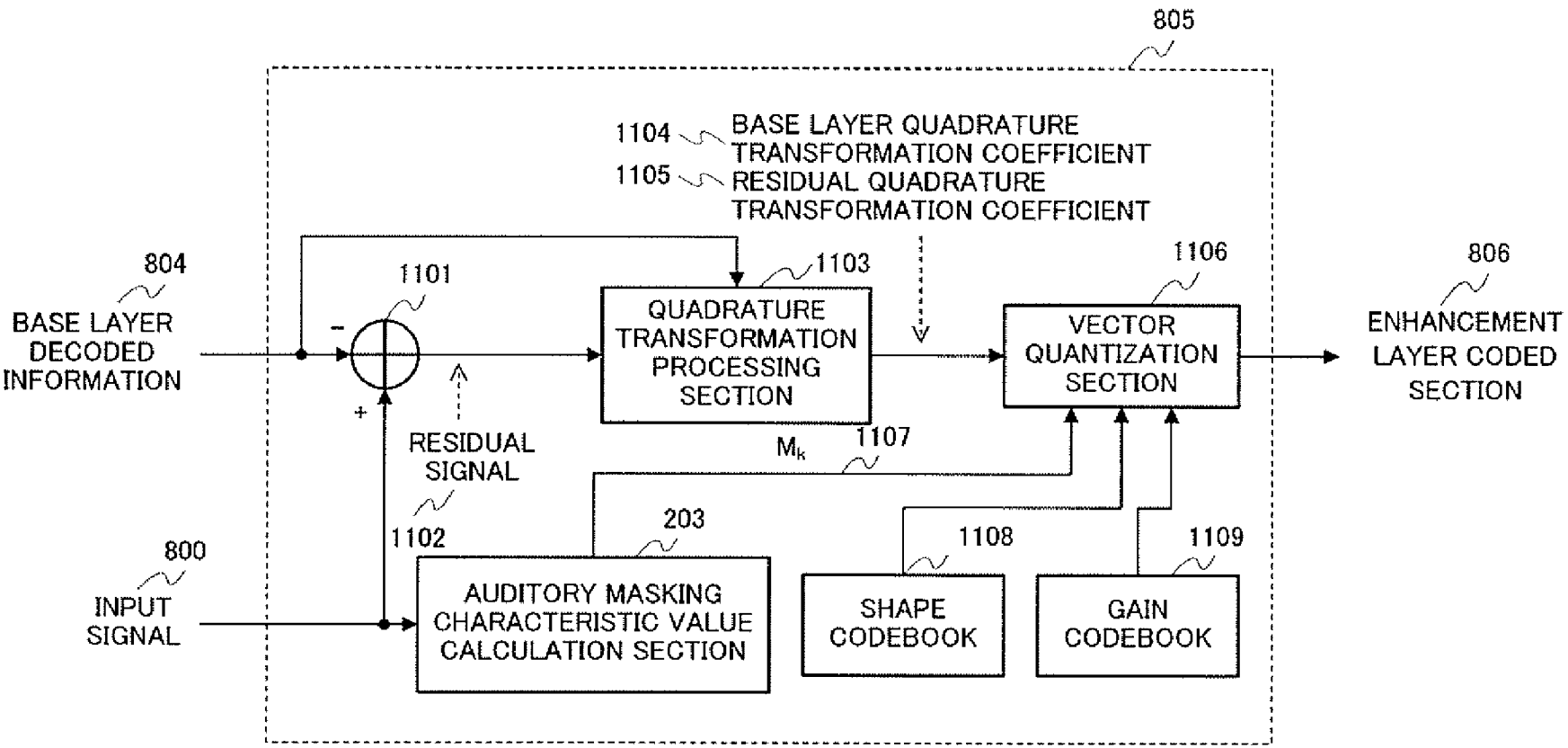
FIG. 11 is a block configuration diagram of an enhancement layer coding section according to Embodiment 2 of the present invention.

Enhancement layer coding section 805 in FIG. 11 is similar to that shown in FIG. 2, except that differential signal 1102 of base layer decoded signal 804 and input signal 800 is input to quadrature transformation processing section 1103, and auditory masking characteristic value calculation section 203 is assigned the same code as in FIG. 2 and is not described here.

As with coding section 101 of Embodiment 1, enhancement layer coding section 805 divides input signal 800 into sections of N samples (where N is a natural number), takes N samples as one frame, and performs coding on a frame-by-frame basis. Here, input signal 800 subject to coding will be designated $x_n$ (n=0, Λ, N−1).

Input signal $x_n$ 800 is input to auditory masking characteristic value calculation section 203 and adding section 1101. Also, base layer decoded signal 804 output from base layer decoding section 803 is input to adding section 1101 and quadrature transformation processing section 1103.

Adding section 1101 finds residual signal 1102 $xresid_n$ (n=0, Λ, N−1) by means of Equation (42), and outputs residual signal 1102 $xresid_n$ to quadrature transformation processing section 1103.

$$xresid_n = x_n - xbase_n (n=0, \ldots, N-1) \quad \text{[Equation 42]}$$

Here, $xbase_n$ (n=0, Λ, N−1) is base layer decoded signal 804, Next, the process performed by quadrature transformation processing section 1103 will be described.

Quadrature transformation processing section 1103 has internal buffers $bufbase_n$ (n=0, Λ, N−1) used in base layer decoded signal $xbase_n$ 804 processing, and $bufresid_n$ (n=0, Λ, N−1) used in residual signal $xresid_n$ 1102 processing, and initializes these buffers by means of Equation (43) and Equation (44) respectively.

$$bufbase_n = 0 (n=0, \ldots, N-1) \quad \text{[Equation 43]}$$

$$bufresid_n = 0 (n=0, \ldots, N-1) \quad \text{[Equation 44]}$$

Quadrature transformation processing section 1103 then finds base layer quadrature transformation coefficient $xbase_k$ 1104 and residual quadrature transformation coefficient $xresid_k$ 1105 by performing a modified discrete cosine transform (MDCT) on base layer decoded signal $xbase_n$ 804 and residual signal $xresid_n$ 1102, respectively. Base layer quadrature transformation coefficient $xbase_k$ 1104 here is found by means of Equation (45).

$$Xbase_k = \frac{2}{N}\sum_{n=0}^{2N-1} xbase'_n \cos\left[\frac{(2n+1+N)}{(2k+1)\pi}{4N}\right] \quad (k = 0, \ldots, N-1) \quad \text{[Equation 45]}$$

Here, $xbase_n'$ is a vector linking base layer decoded signal $xbase_n$ 804 and buffer $bufbase_n$, and quadrature transformation processing section 1103 finds $xbase_n'$ by means of Equation (46). Also, k is the index of each sample in one frame.

$$xbase'_n = \begin{cases} bufbase_n & (n = 0, \ldots N-1) \\ xbase_{n-N} & (n = N, \ldots 2N-1) \end{cases} \quad \text{[Equation 46]}$$

Next, quadrature transformation processing section 1103 updates buffer $bufbase_n$ by means of Equation (47).

$$bufbase_n = xbase_n (n=0, \ldots, N-1) \quad \text{[Equation 47]}$$

Also, quadrature transformation processing section 1103 finds residual quadrature transformation coefficient $xresid_k$ 1105 by means of Equation (48).

$$Xresid_k = \frac{2}{N}\sum_{n=0}^{2N-1} xresid'_n \cos\left[\frac{(2n+1+N)}{(2k+1)\pi}{4N}\right] \quad (k = 0, \ldots, N-1) \quad \text{[Equation 48]}$$

Here, $xresid_n'$ is a vector linking residual signal $xresid_n$ 1102 and buffer $bufresid_n$, and quadrature transformation processing section 1103 finds $xresid_n'$ by means of Equation (49). Also, k is the index of each sample in one frame.

$$xresid_n' = \begin{cases} bufresid_n & (n = 0, \ldots N-1) \\ xresid_{n-N} & (n = N, \ldots 2N-1) \end{cases} \quad \text{[Equation 49]}$$

Next, quadrature transformation processing section 1103 updates buffer $bufresid_n$ by means of Equation (50).

$$bufresid_n = xresid_n (n=0, \ldots, N-1) \quad \text{[Equation 50]}$$

Quadrature transformation processing section 1103 then outputs base layer quadrature transformation coefficient $Xbase_k$ 1104 and residual quadrature transformation coefficient $Xresid_k$ 1105 to vector quantization section 1106.

Vector quantization section 1106 has, as input, base layer quadrature transformation coefficient $Xbase_k$ 1104 and residual quadrature transformation coefficient $Xresid_k$ 1105 from quadrature transformation processing section 1103, and auditory masking characteristic value $M_k$ 1107 from auditory masking characteristic value calculation section 203, and using shape codebook 1108 and gain codebook 1109, performs coding of residual quadrature transformation coefficient $Xresid_k$ 1105 by means of vector quantization using the auditory masking characteristic value, and outputs enhancement layer coded information 806 obtained by coding.

Here, shape codebook 1108 is composed of previously created $N_e$ kinds of N-dimensional code vectors $coderesid_k^e$ (e=0, Λ, $N_e$−1, k=0, Λ, N−1), and is used when performing vector quantization of residual quadrature transformation coefficient $Xresid_k$ 1105 in vector quantization section 1106.

Also, gain codebook 1109 is composed of previously created $N_f$ kinds of residual gain codes $gainresid^f$ (f=0, Λ, $N_f$−1), and is used when performing vector quantization of residual quadrature transformation coefficient $Xresid_k$ 1105 in vector quantization section 1106.

Figure 12:
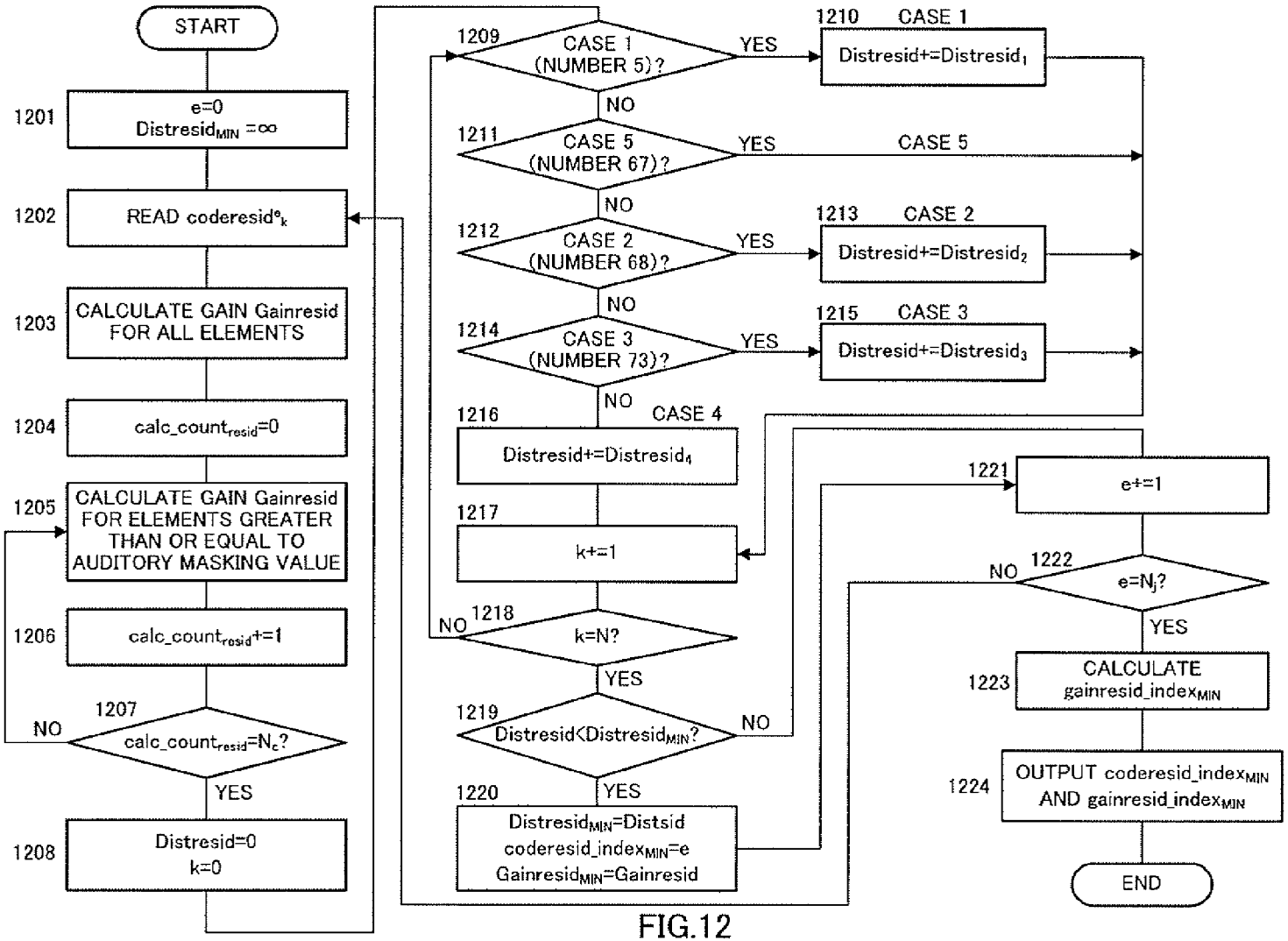
FIG. 12 is a flowchart of a vector quantization section according to Embodiment 2 of the present invention.

The process performed by vector quantization section 1106 will now be described in detail using FIG. 12. In step 1201, initialization is performed by assigning 0 to code vector index e in shape codebook 1108, and a sufficiently large value to minimum error $Dist_{MIN}$.

In step 1202, N-dimensional code vector $coderesid_k^e$ (k=0, Λ, N−1) is read from shape codebook 1108.

In step 1203, residual quadrature transformation coefficient $Xresid_k$ output from quadrature transformation processing section 1103 is input, and gain Gainresid of code vector $coderesid_k^e$ (k=0, Λ, N−1) read in step 1202 is found by means of Equation (51).

$$Gainresid = \frac{\sum_{k=0}^{N-1} Xresid_k \cdot coderesid_k^e}{\sum_{k=0}^{N-1} coderesid_k^{e\,2}} \quad \text{[Equation 51]}$$

In step 1204, 0 is assigned to $calc_count_{resid}$ indicating the number of executions of step 1205.

In step 1205, auditory masking characteristic value $M_k$ output from auditory masking characteristic value calculation section 203 is input, and temporary gain $temp2_k$ (k=0, Λ, N−1) is found by means of Equation (52).

$$temp2_k = \begin{cases} coderesid_k^e & (|coderesid_k^e \cdot Gainresid + Xbase_k| \geq M_k) \\ 0 & (|coderesid_k^e \cdot Gainresid + Xbase_k| < M_k) \end{cases} \quad (k = 0, \cdots, N-1) \quad \text{[Equation 52]}$$

In Equation (52), if k satisfies the condition $|coderesid_k^e \cdot Gainresid + Xbase_k| \geqq M_k$, $coderesid_k^e$ is assigned to temporary gain $temp2_k$, and if k satisfies the condition $|coderesid_k^e \cdot Gainresid + Xbase_k| < M_k$, 0 is assigned to $temp2_k$. Here, k is the index of each sample in one frame.

Then, in step 1205, gain Gainresid is found by means of Equation (53).

$$Gainresid = \sum_{k=0}^{N-1} Xresid_k \cdot temp2_k \Big/ \sum_{k=0}^{N-1} temp2_k^2 \quad (k = 0, \cdots, N-1) \quad \text{[Equation 53]}$$

If temporary gain $temp2_k$ is 0 for all k's, 0 is assigned to gain Gainresid. Also, residual coded value $Rresid_k$ is found from gain Gainresid and code vector $coderesid_k^e$ by means of Equation (54).

$$Rresid_k = Gainresid \cdot coderesid_k^e (k=0, \ldots, N-1) \quad \text{[Equation 54]}$$

Also, addition coded value $Rplus_k$ is found from residual coded value $Rresid_k$ and base layer quadrature transformation coefficient $Xbase_k$ by means of Equation (55).

$$Rplus_k = Rresid_k + Xbase_k (k=0, \ldots, N-1) \quad \text{[Equation 55]}$$

In step 1206, $calc_count_{resid}$ is incremented by 1.

In step 1207, $calc_count_{resid}$ and a predetermined non-negative integer $Nresid_c$ are compared, and the process flow returns to step 1205 if $calc_count_{resid}$ is a smaller value than $Nresid_c$, or proceeds to step 1208 if $calc_count_{resid}$ is greater than or equal to $Nresid_c$.

In step 1208, 0 is assigned to cumulative error Distresid, and 0 is also assigned to sample index k. Also, in step 1208, addition MDCT coefficient $Xplus_k$ is found by means of Equation (56).

$$Xplus_k = Xbase_k + Xresid_k (k=0, \ldots, N-1) \quad \text{[Equation 56]}$$

Figure 13:
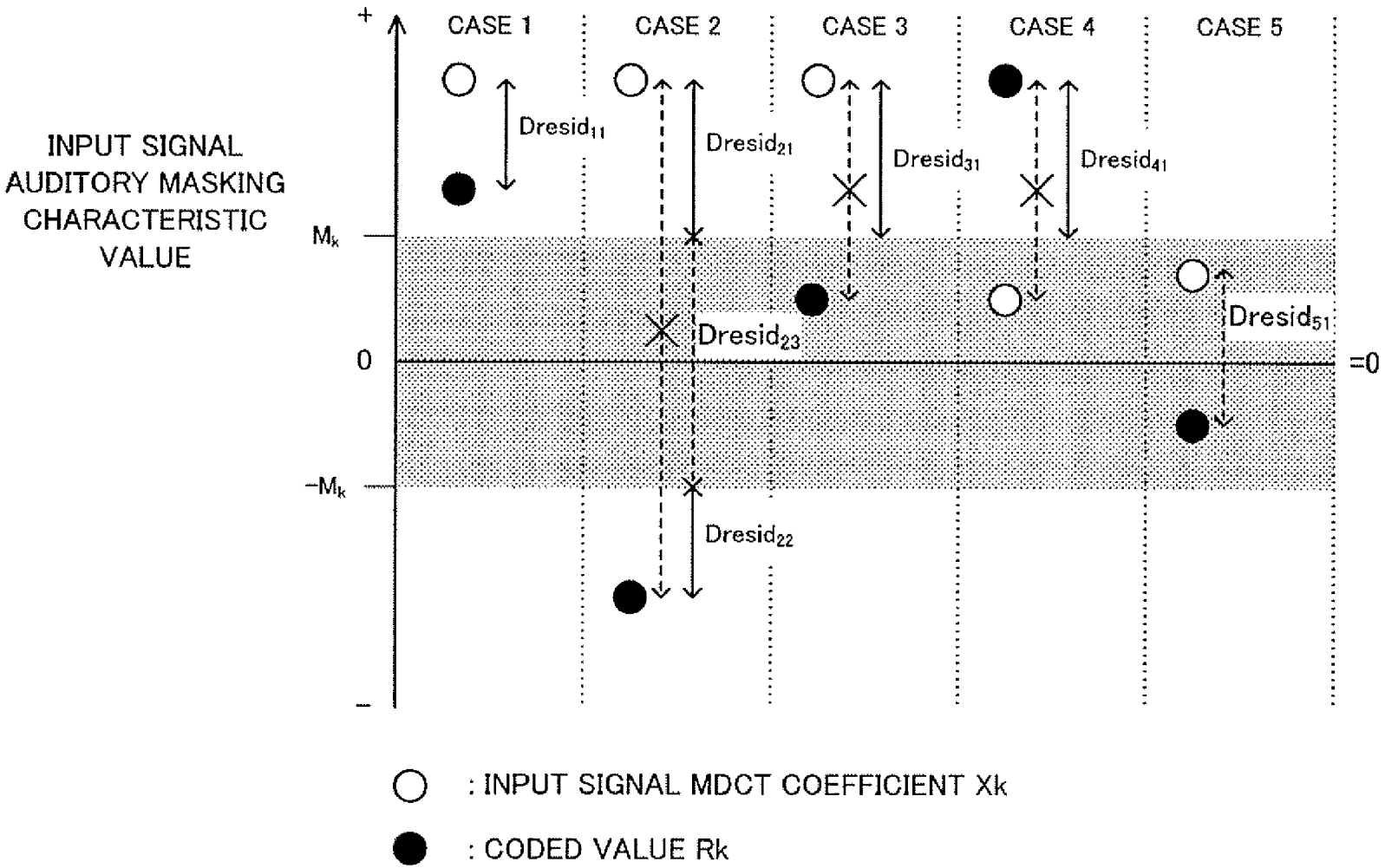
FIG. 13 is a drawing explaining the relative positional relationship of auditory masking characteristic values, coded values, and MDCT coefficients according to Embodiment 2 of the present invention.

Next, in steps 1209, 1211, 1212, and 1214, case determination is performed for the relative positional relationship between auditory masking characteristic value $M_k$ 1107, addition coded value $Rplus_k$, and addition MDCT coefficient $Xplus_k$, and distance calculation is performed in step 1210, 1213, 1215, or 1216 according to the case determination result. This case determination according to the relative positional relationship is shown in FIG. 13. In FIG. 13, a white circle symbol (○) signifies an addition MDCT coefficient $Xplus_k$, and a black circle symbol (•) signifies an addition coded value $Rplus_k$. The concepts in FIG. 13 are the same as explained for FIG. 6 in Embodiment 1.

In step 1209, whether or not the relative positional relationship between auditory masking characteristic value $M_k$, addition coded value $Rplus_k$, and addition MDCT coefficient $Xplus_k$ corresponds to "Case 1" in FIG. 13 is determined by means of the conditional expression in Equation (57).

$$(|Xplus_k| \geqq M_k) \text{ and } (|Rplus_k| \geqq M_k) \text{ and } (Xplus_k \cdot Rplus_k \geqq 0) \quad \text{[Equation 57]}$$

Equation (57) signifies a case in which the absolute value of addition MDCT coefficient $Xplus_k$ and the absolute value of addition coded value $Rplus_k$ are both greater than or equal to auditory masking characteristic value $M_k$, and addition MDCT coefficient $Xplus_k$ and addition coded value $Rplus_k$ are the same codes. If auditory masking characteristic value $M_k$, addition MDCT coefficient $Xplus_k$, and addition coded value $Rplus_k$ satisfy the conditional expression in Equation (57), the process flow proceeds to step 1210, and if they do not satisfy the conditional expression in Equation (57), the process flow proceeds to step 1211.

In step 1210, error $Distresid_1$ between $Rplus_k$ and addition MDCT coefficient $Xplus_k$ is found by means of Equation (58), error $Distresid_1$ is added to cumulative error Distresid, and the process flow proceeds to step 1217.

$$Distresid_1 = Dresid_{11} = |Xresid_k - Rresid_k| \quad \text{[Equation 58]}$$

In step 1211, whether or not the relative positional relationship between auditory masking characteristic value $M_k$, addition coded value $Rplus_k$, and addition MDCT coefficient $Xplus_k$ corresponds to "Case 5" in FIG. 13 is determined by means of the conditional expression in Equation (59).

$$(|XPlus_k| < M_k) \text{ and } (|Rplus_k| < M_k) \quad \text{[Equation 59]}$$

Equation (59) signifies a case in which the absolute value of addition MDCT coefficient $Xplus_k$ and the absolute value of addition coded value $Rplus_k$ are both less than auditory masking characteristic value $M_k$. If auditory masking characteristic value $M_k$, addition coded value $Rplus_k$, and addition MDCT coefficient $Xplus_k$ satisfy the conditional expression in Equation (59), the error between addition coded value $Rplus_k$ and addition MDCT coefficient $Xplus_k$ is taken to be 0, nothing is added to cumulative error Distresid, and the process flow proceeds to step 1217. If auditory masking characteristic value $M_k$, addition coded value $Rplus_k$, and addition MDCT coefficient $Xplus_k$ do not satisfy the conditional expression in Equation (59), the process flow proceeds to step 1212.

In step 1212, whether or not the relative positional relationship between auditory masking characteristic value $M_k$, addition coded value $Rplus_k$, and addition MDCT coefficient $Xplus_k$ corresponds to "Case 2" in FIG. 13 is determined by means of the conditional expression in Equation (60).

$$(|Xplus_k| \geqq M_k) \text{ and } (|Rplus_k| \geqq M_k) \text{ and } (Xplus_k \cdot Rplus_k < 0) \quad \text{[Equation 60]}$$

Equation (60) signifies a case in which the absolute value of addition MDCT coefficient $Xplus_k$ and the absolute value of addition coded value $Rplus_k$ are both greater than or equal to auditory masking characteristic value $M_k$, and addition MDCT coefficient $Xplus_k$ and addition coded value $Rplus_k$ are different codes. If auditory masking characteristic value $M_k$, addition MDCT coefficient $Xplus_k$, and addition coded value $Rplus_k$ satisfy the conditional expression in Equation (60), the process flow proceeds to step 1213, and if they do not satisfy the conditional expression in Equation (60), the process flow proceeds to step 1214.

In step 1213, error $Distresid_2$ between addition coded value $Rplus_k$ and addition MDCT coefficient $Xplus_k$ is found by means of Equation (61), error $Distresid_2$ is added to cumulative error Distresid, and the process flow proceeds to step 1217.

$$Distresid_2 = Dresid_{21} + Dresid_{22} + \beta_{resid} * Dresid_{23} \quad \text{[Equation 61]}$$

Here, $\beta_{resid}$ is a value set as appropriate according to addition MDCT coefficient $Xplus_k$, addition coded value $Rplus_k$, and auditory masking characteristic value $M_k$. A value of 1 or less is suitable for $\beta_{resid}$. $Dresid_{21}$, $Dresid_{22}$, and $Dresid_{23}$ are found by means of Equation (62), Equation (63), and Equation (64), respectively.

$$Dresid_{21} = |Xplus_k| - M_k \quad \text{[Equation 62]}$$

$$Dresid_{22} = Rplus_k| - M_k \quad \text{[Equation 63]}$$

$$Dresid_{23} = M_k \cdot 2 \quad \text{[Equation 64]}$$

In step 1214, whether or not the relative positional relationship between auditory masking characteristic value $M_k$, addition coded value $Rplus_k$, and addition MDCT coefficient $Xplus_k$ corresponds to "Case 3" in FIG. 13 is determined by means of the conditional expression in Equation (65).

$$(|Xplus_k| \geqq M_k) \text{ and } (|Rplus_k| < M_k) \quad \text{[Equation 65]}$$

Equation (65) signifies a case in which the absolute value of addition MDCT coefficient $Xplus_k$ is greater than or equal to auditory masking characteristic value $M_k$, and addition coded value $Rplus_k$ is less than auditory masking characteristic value $M_k$. If auditory masking characteristic value $M_k$, addition MDCT coefficient $Xplus_k$, and addition coded value $Rplus_k$ satisfy the conditional expression in Equation (65), the process flow proceeds to step 1215, and if they do not satisfy the conditional expression in Equation (65), the process flow proceeds to step 1216.

In step 1215, error $Distresid_3$ between addition coded value $Rplus_k$ and addition MDCT coefficient $Xplus_k$ is found by means of Equation (66), error $Distresid_3$ is added to cumulative error Distresid, and the process flow proceeds to step 1217.

$$Distresid_3 = Dresid_{31} = |Xplus_k| - M_k \quad \text{[Equation 66]}$$

In step 1216, the relative positional relationship between auditory masking characteristic value $M_k$, addition coded value $Rplus_k$, and addition MDCT coefficient $Xplus_k$ corresponds to "Case 4" in FIG. 13, and the conditional expression in Equation (67) is satisfied.

$$(|Xplus_k| < M_k) \text{ and } (|Rplus_k| \geqq M_k) \quad \text{[Equation 67]}$$

Equation (67) signifies a case in which the absolute value of addition MDCT coefficient $Xplus_k$ is less than auditory masking characteristic value $M_k$, and addition coded value $Rplus_k$ is greater than or equal to auditory masking characteristic value $M_k$. In step 1216, error $Distresid_4$ between addition coded value $Rplus_k$ and addition MDCT coefficient $Xplus_k$ is found by means of Equation (68), error $Distresid_4$ is added to cumulative error Distresid, and the process flow proceeds to step 1217.

$$Distresid_4 = Dresid_{41} = |Rplus_k| - M_k \quad \text{[Equation 68]}$$

In step 1217, k is incremented by 1.

In step 1218, N and k are compared, and if k is a smaller value than N, the process flow returns to step 1209. If k is greater than or equal to N, the process flow proceeds to step 1219.

In step 1219, cumulative error Distresid and minimum error $Distresid_{MIN}$ are compared, and if cumulative error Distresid is a smaller value than minimum error $Distresid_{MIN}$, the process flow proceeds to step 1220, whereas if cumulative error Distresid is greater than or equal to minimum error $Distresid_{MIN}$, the process flow proceeds to step 1221.

In step 1220, cumulative error Distresid is assigned to minimum error $Distresid_{MIN}$, e is assigned to $gainresid_index_{MIN}$, and gain Distresid is assigned to error minimum gain $Distresid_{MIN}$, and the process flow proceeds to step 1221.

In step 1221, e is incremented by 1.

In step 1222, total number of vectors $N_e$ and e are compared, and if e is a smaller value than $N_e$, the process flow returns to step 1202. If e is greater than or equal to $N_e$, the process flow proceeds to step 1223.

In step 1223, $N_f$ kinds of residual gain code gainresid$^f$ (f=0, Λ, $N_f$−1) are read from gain codebook 1109, and quantization residual gain error gainresiderr$^f$ (f=0, Λ, $N_f$−1) is found by means of Equation (69) for all f's.

$$\text{gainresiderr}^f=|\text{Gainresid}_{MIN}-\text{gainresid}^f|(f=0,\ldots,N_f-1) \quad \text{[Equation 69]}$$

Then, in step 1223, f for which quantization residual gain error gainresiderr$^f$ (f=0, Λ, $N_f$−1) is a minimum is found, and the found f is assigned to gainresid_index$_{MIN}$.

In step 1224, gainresid_index$_{MIN}$ that is the code vector index for which cumulative error Distresid is a minimum, and gainresid_index$_{MIN}$ found in step 1223, are output to transmission channel 807 as enhancement layer coded information 806, and processing is terminated.

Figure 14:
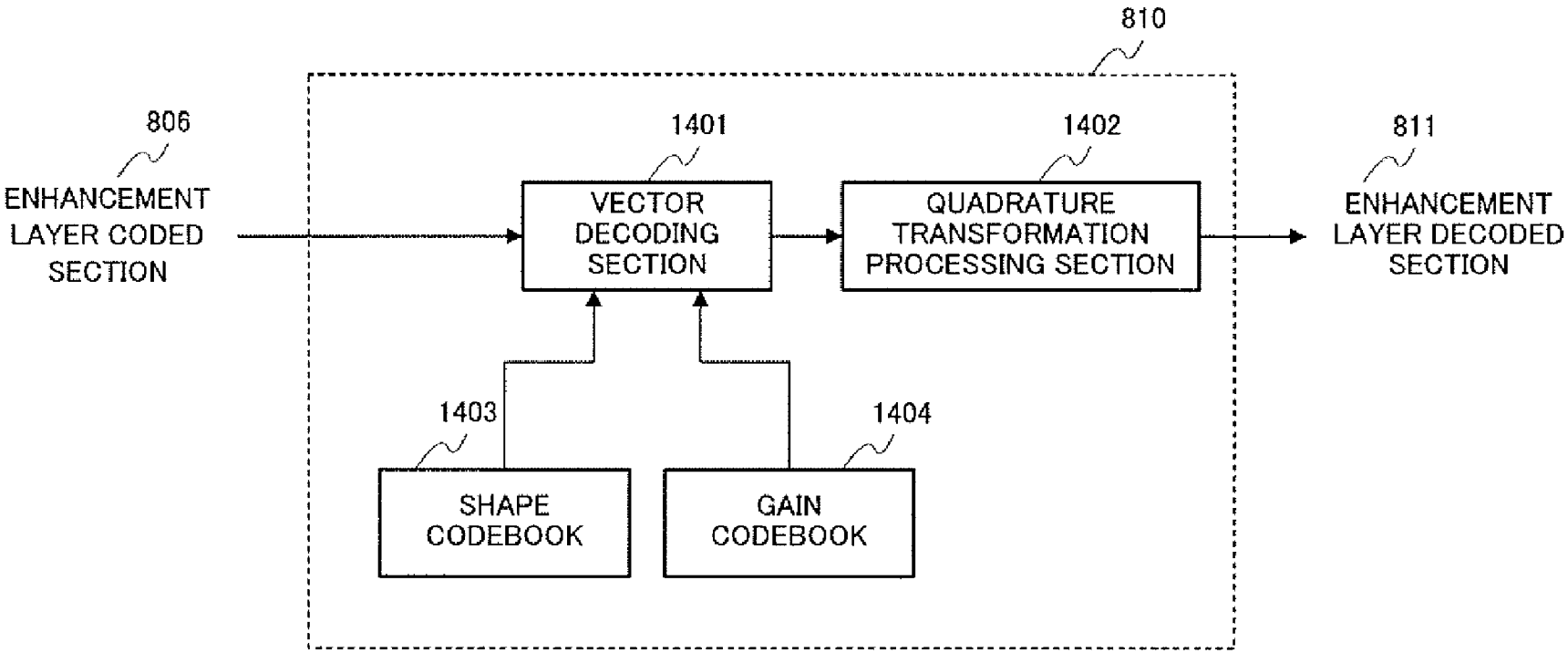
FIG. 14 is a block configuration diagram of a decoding section according to Embodiment 2 of the present invention.

Next, enhancement layer decoding section 810 will be described using the block diagram in FIG. 14. In the same way as shape codebook 1108, shape codebook 1403 is composed of $N_e$ kinds of N-dimensional code vectors gainresid$_k^e$ (e=0, Λ, $N_e$−1, k=0, Λ, N−1), and in the same way as gain codebook 1109, gain codebook 1404 is composed of $N_f$ kinds of residual gain codes gainresid$^f$ (f=0, Λ, $N_f$−1).

Vector decoding section 1401 has enhancement layer coded information 806 transmitted via transmission channel 807 as input, and using gainresid_index$_{MIN}$ and gainresid_index$_{MIN}$ as the coded information, reads code vector coderesid$_k^{coderesid_indexMIN}$ (k=0, Λ, N−1) from shape codebook 1403, and also reads code gainresid$^{gainresid_indexMIN}$ from gain codebook 1404. Then, vector decoding section 1401 multiplies gainresid$^{gainresid_indexMIN}$ by coderesid$_k^{coderesid_indexMIN}$ (k=0, Λ, N−1), and outputs gainresid$^{gainresid_indexMIN}$, coderesid$_k^{coderesid_indexMIN}$ (k=0, Λ, N−1) obtained as a result of the multiplication to a residual quadrature transformation processing section 1402 as a decoded residual quadrature transformation coefficient.

The process performed by residual quadrature transformation processing section 1402 will now be described.

Residual quadrature transformation processing section 1402 has an internal buffer bufresid$_k$', and initializes this buffer in accordance with Equation (70).

$$\text{bufresid}'_k=0(k=0,\ldots,N-1) \quad \text{[Equation 70]}$$

Decoded residual quadrature transformation coefficient gainresid$^{gainresid_indexMIN}$ coderesid$_k^{coderesid_indexMIN}$ (k=0, Λ, N−1) output from vector decoding section 1401 is input, and enhancement layer decoded signal yresid$_n$ 811 is found by means of Equation (71).

$$yresid_n=\frac{2}{N}\sum_{k=0}^{2N-1}Xresid'_k\cos\left[\frac{(2n+1+N)(2k+1)\pi}{4N}\right] \quad \text{[Equation 71]}$$

$$(n=0,\cdots,N-1)$$

Here, Xresid$_k$' is a vector linking decoded residual quadrature transformation coefficient gainresid$^{gainresid_indexMIN}$·coderesid$_k^{coderesid_indexMIN}$ (k=0, Λ, N−1) and buffer bufresid$_k$', and is found by means of Equation (72).

$$Xresid'_k=\begin{cases} bufresid'_k & (k=0,\cdots N-1) \\ gainresid^{\text{gainresid_index}_{\text{MIN}}}\cdot coderesid_{k-N}^{\text{coderesid_index}_{\text{MIN}}} & (k=N,\cdots 2N-1)\end{cases} \quad \text{[Equation 72]}$$

Buffer bufresid$_k$' is then updated by means of Equation (73).

$$\text{bufresid}'_k=\text{gainresid}^{gainresid_indexMIN}\cdot\text{coderesid}_k^{coderesid_indexMIN}(k=0,\ldots N-1) \quad \text{[Equation 73]}$$

Enhancement layer decoded signal yresid$_n$ 811 is then output.

The present invention has no restrictions concerning scalable coding layers, and can also be applied to a case in which vector quantization using an auditory masking characteristic value is performed in an upper layer in a hierarchical voice coding and decoding method with three or more layers.

In vector quantization section 1106, quantization may be performed by applying acoustic weighting filters to distance calculations in above-described Case 1 through Case 5.

In this embodiment, a CELP type voice coding and decoding method has been described as the voice coding and decoding method of the base layer coding section and decoding section by way of example, but another voice coding and decoding method may also be used.

Also, in this embodiment, an example has been given in which base layer coded information and enhancement layer coded information are transmitted separately, but a configuration may also be taken, whereby coded information of each layer is transmitted multiplexed, and demultiplexing is performed on the receiving side to decode the coded information of each layer.

Thus, in a scalable coding system, also, applying vector quantization that uses an auditory masking characteristic value of the present invention makes it possible to select a suitable code vector that minimizes degradation of a signal that has a large auditory effect, and obtain a high-quality output signal.

Embodiment 3

Figure 15:
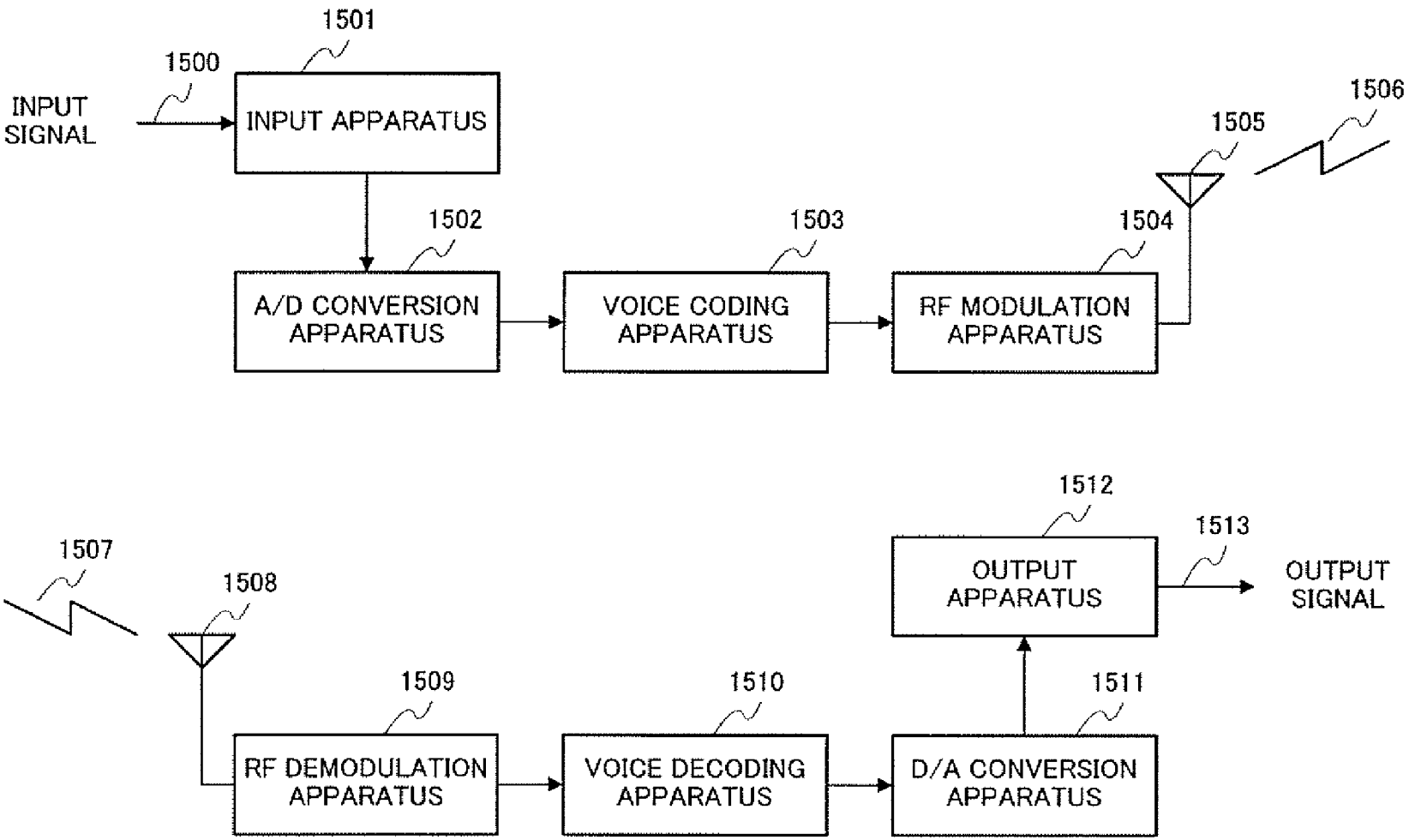
FIG. 15 is a block configuration diagram of a voice signal transmitting apparatus and voice signal receiving apparatus according to Embodiment 3 of the present invention.

FIG. 15 is a block diagram showing the configuration of a voice signal transmitting apparatus and voice signal receiving apparatus containing the coding apparatus and decoding apparatus described in above Embodiments 1 and 2 according to Embodiment 3 of the present invention. More specific applications include mobile phones, car navigation systems, and the like.

In FIG. 15, input apparatus 1502 performs A/D conversion of voice signal 1500 to a digital signal, and outputs this digital signal to voice/musical tone coding apparatus 1503.

Voice/musical tone coding apparatus 1503 is equipped with voice/musical tone coding apparatus 101 shown in FIG. 1, codes a digital signal output from input apparatus 1502, and outputs coded information to RF modulation apparatus 1504. RF modulation apparatus 1504 converts voice coded information output from voice/musical tone coding apparatus 1503 to a signal to be sent on propagation medium such as a radio wave, and outputs the resulting signal to transmitting antenna 1505.

Transmitting antenna 1505 sends the output signal output from RF modulation apparatus 1504 as a radio wave (RF signal). RF signal 1506 in the figure represents a radio wave (RF signal) sent from transmitting antenna 1505. This completes a description of the configuration and operation of a voice signal transmitting apparatus.

RF signal 1507 is received by receiving antenna 1508, and is output to RF demodulation apparatus 1509. RF signal 1507 in the figure represents a radio wave received by receiving antenna 1508, and as long as there is no signal attenuation or noise superimposition in the propagation path, is exactly the same as RF signal 1506.

RF demodulation apparatus 1509 demodulates voice coded information from the RF signal output from receiving antenna 1508, and outputs the result to voice/musical tone decoding apparatus 1510. Voice/musical tone decoding apparatus 1510 is equipped with voice/musical tone decoding apparatus 105 shown in FIG. 1, and decodes a voice signal from voice coded information output from RF demodulation apparatus 1509. Output apparatus 1511 performs D/A conversion of the decoded digital voice signal to an analog signal, converts the electrical signal to vibrations of the air, and outputs sound waves audible to the human ear.

Thus, a high-quality output signal can be obtained in both a voice signal transmitting apparatus and a voice signal receiving apparatus.

The present application is based on Japanese Patent Application No. 2003-433160 filed on Dec. 26, 2003, the entire content of which is expressly incorporated herein by reference.

INDUSTRIAL APPLICABILITY

The present invention has advantages of selecting a suitable code vector that minimizes degradation of a signal that has a large auditory effect, and obtaining a high-quality output signal by applying vector quantization that uses an auditory masking characteristic value. Also, the present invention is applicable to the fields of packet communication systems typified by Internet communications, and mobile communication systems such as mobile phone and car navigation systems.

The invention claimed is:

1. A voice and musical tone coding apparatus, comprising:

a quadrature transformation processor that converts a voice and musical tone signal from a time component to a frequency component;

an auditory masking characteristic value calculator that finds an auditory masking characteristic value from said voice and musical tone signal; and a vector quantizer that, when one of said voice and musical tone signal frequency component and elements of code vector is within an auditory masking area indicated by said auditory masking characteristic value, performs vector quantization by changing a method of calculating a distance between said voice and musical tone signal frequency component and said elements of code vector based on said auditory masking characteristic value, to a method whereby said distance is calculated by correcting said one of said voice and musical tone signal frequency component and elements of said code vector in said auditory masking area, in a direction where said distance between said voice and musical tone signal frequency component and elements of said code vector is reduced, to a boundary position in said auditory masking area.

2. A voice and musical tone coding apparatus, comprising:

a quadrature transformation processor that converts a voice and musical tone signal from a time component to a frequency component;

an auditory masking characteristic value calculator that finds an auditory masking characteristic value from said voice and musical tone signal; and a vector quantizer that, when codes of said voice and musical tone signal frequency component and elements of code vector differ, and said voice and musical tone signal frequency component and said elements of code vector are outside an auditory masking area indicated by said auditory masking characteristic value, performs vector quantization by changing a method of calculating a distance between said voice and musical tone signal frequency component and said elements of code vector based on said auditory masking characteristic value, to a method whereby, in said distance between said voice and musical tone signal frequency component and said elements of code vector, said distance is calculated by correcting a distance between two boundaries of said auditory masking area to a value multiplying said distance between said two boundaries by a coefficient equal to or less than one.

3. A voice and musical tone coding method of a voice and musical tone coding apparatus having a quadrature transformation processor, an auditory masking characteristic value calculator and a vector quantizer, comprising:

converting a voice and musical tone signal from a time component to a frequency component in the quadrature transformation processor;

finding an auditory masking characteristic value from said voice and musical tone signal in the auditory masking characteristic value calculator; and performing, in the vector quantizer, a vector quantization by changing a method of calculating a distance between said voice and musical tone signal frequency component and elements of code vector based on said auditory masking characteristic value, when one of said voice and musical tone signal frequency component and said elements of code vector is within an auditory masking area indicated by said auditory masking characteristic value, to a method whereby said distance is calculated by correcting said one of said voice and musical tone signal frequency component and elements of said code vector in said auditory masking area, in a direction where said distance between said voice and musical tone signal frequency component and elements of said code vector is reduced, to a boundary position in said auditory masking area.

4. A voice and musical tone coding method of a voice and musical tone coding apparatus having a quadrature transformation processor, an auditory masking characteristic value calculator and a vector quantizer, comprising:

converting a voice and musical tone signal from a time component to a frequency component in the quadrature transformation processor;

finding an auditory masking characteristic value from said voice and musical tone signal in the auditory masking characteristic value calculator; and performing, in the vector quantizer, a vector quantization by changing a method of calculating a distance between said voice and musical tone signal frequency component and elements of code vector based on said auditory masking characteristic value, when codes of said voice and musical tone signal frequency component and said elements of code vector differ, and said voice and musical tone signal frequency component and said elements of code vector are outside an auditory masking area indicated by said auditory masking characteristic value, to a method whereby, in said distance between said voice and musical tone signal frequency component and said elements of code vector, said distance is calculated by correcting a distance between two boundaries of said auditory masking area to a value multiplying said distance between said two boundaries by a coefficient equal to or less than one.

* * * * *